US010775749B2

(12) United States Patent
Dunn et al.

(10) Patent No.: US 10,775,749 B2
(45) Date of Patent: Sep. 15, 2020

(54) ROBUST AND RESILIENT TIMING ARCHITECTURE FOR CRITICAL INFRASTRUCTURE

(71) Applicant: The MITRE Corporation, McLean, VA (US)

(72) Inventors: Jeffrey Dunn, Ellicott City, MD (US); Sean McKenna, Salem, NH (US); Cynthia E. Martin, Ellicott City, MD (US); Michael L. Cohen, Bethesda, MD (US)

(73) Assignee: The MITRE Corporation, McLean, VA (US)

( * ) Notice: Subject to any disclaimer, the term of this patent is extended or adjusted under 35 U.S.C. 154(b) by 297 days.

(21) Appl. No.: 14/690,225

(22) Filed: Apr. 17, 2015

(65) Prior Publication Data

US 2016/0306048 A1 Oct. 20, 2016

(51) Int. Cl.
*G04G 7/00* (2006.01)
*G04R 20/02* (2013.01)

(52) U.S. Cl.
CPC ..... *G04G 7/00* (2013.01); *G04R 20/02* (2013.01)

(58) Field of Classification Search
CPC ..... G04G 7/00; G04R 20/02
See application file for complete search history.

(56) References Cited

U.S. PATENT DOCUMENTS 5,440,313 A 8/1995 Osterdock et al.
5,477,228 A * 12/1995 Tiwari ..... G01S 19/41 342/357.44
5,612,703 A 3/1997 Mallinckrodt
5,663,734 A 9/1997 Krasner
(Continued)

FOREIGN PATENT DOCUMENTS

WO WO-2006/088472 8/2006

OTHER PUBLICATIONS

Achkar, J. et al. "Development of a Two Way Satellite Time and Frequency Transfer Station at BNM-SYRTE," *Proceedings of the 2003 IEEE International Frequency Control Symposium and PDA Exhibition Jointly with the 17th European Frequency and Time Forum*, May 4-8, 2003, Paris, France; 4 pages.
(Continued)

*Primary Examiner* — Hassan Kizou
*Assistant Examiner* — Deepa Belur
(74) *Attorney, Agent, or Firm* — Morrison & Foerster LLP

(57) ABSTRACT

A device for transmitting synchronized timing including a receiver, a transmitter, one or more processors, memory, and one or more programs, wherein the one or more programs are stored in the memory and configured to be executed by the one or more processors, the programs including instructions for receiving through the receiver a timing signal comprising first time information that is synchronized to a time standard, determining second time information based at least partially on the first time information, composing a
(Continued)

message formatted in accordance with a global navigation satellite system (GNSS) standard, wherein the message comprises the second time information, and transmitting the message through the transmitter on a radio signal having a frequency in the frequency modulation (FM) radio frequency band.

37 Claims, 9 Drawing Sheets

(56) References Cited

U.S. PATENT DOCUMENTS

| | | | | |
|---|---|---|---|---|
| 6,072,996 | A | 6/2000 | Smith | |
| 6,094,168 | A | 7/2000 | Duffett-Smith et al. | |
| 6,134,228 | A | 10/2000 | Cedervall et al. | |
| 6,150,980 | A | 11/2000 | Krasner | |
| 6,219,385 | B1 | 4/2001 | Weinberg | |
| 6,590,524 | B1 * | 7/2003 | Farley | G01S 19/11 342/357.48 |
| 7,154,437 | B2 | 12/2006 | Bromley et al. | |
| 7,321,776 | B2 | 1/2008 | Camp, Jr. et al. | |
| 7,327,699 | B1 | 2/2008 | Schäfer | |
| 8,055,288 | B2 | 11/2011 | Ladd et al. | |
| 8,179,318 | B1 | 5/2012 | Furman et al. | |
| 8,224,283 | B2 | 7/2012 | Khushu et al. | |
| 8,432,311 | B2 | 4/2013 | Ebata et al. | |
| 8,451,166 | B2 | 5/2013 | Gayrard et al. | |
| 8,451,814 | B2 | 5/2013 | Rausch et al. | |
| 2001/0050633 | A1 | 12/2001 | Thomas | |
| 2001/0053699 | A1 | 12/2001 | McCrady et al. | |
| 2002/0167417 | A1 | 11/2002 | Welles, II et al. | |
| 2008/0117102 | A1 * | 5/2008 | Syrjarinne | G01S 19/05 342/357.42 |
| 2009/0117928 | A1 * | 5/2009 | Ladd | G04R 20/06 455/502 |
| 2009/0322603 | A1 | 12/2009 | Liao | |
| 2010/0118895 | A1 * | 5/2010 | Radulescu | G04G 7/00 370/503 |
| 2010/0150117 | A1 | 6/2010 | Aweya et al. | |
| 2010/0220004 | A1 * | 9/2010 | Malkos | G01S 19/05 342/357.62 |
| 2010/0273426 | A1 * | 10/2010 | Walley | H04W 52/265 455/63.1 |
| 2011/0018761 | A1 * | 1/2011 | Walley | G01S 19/35 342/357.28 |
| 2011/0156878 | A1 * | 6/2011 | Wu | G01S 5/0081 340/10.1 |
| 2012/0075138 | A1 | 3/2012 | Stayton et al. | |
| 2012/0262339 | A1 | 10/2012 | Garcia et al. | |
| 2013/0141280 | A1 * | 6/2013 | Huang | G01S 19/235 342/357.76 |
| 2014/0028498 | A1 * | 1/2014 | Lin | G01S 19/33 342/357.63 |
| 2014/0097985 | A1 | 4/2014 | Kim | |
| 2014/0184442 | A1 * | 7/2014 | Large | G01S 19/43 342/357.42 |
| 2014/0253369 | A1 * | 9/2014 | Kelley | G01S 19/07 342/175 |
| 2015/0055686 | A1 * | 2/2015 | Hryciuk | H04B 1/7156 375/137 |
| 2016/0054450 | A1 * | 2/2016 | Lennen | G01S 19/33 342/357.73 |
| 2016/0234795 | A1 * | 8/2016 | Ekstedt | H04W 56/00 |
| 2016/0269170 | A1 * | 9/2016 | Kurby | H03L 1/00 |
| 2016/0277197 | A1 * | 9/2016 | Jose | H04W 64/00 |

OTHER PUBLICATIONS

Bernhardt, M. G. et al. "Autonomous Spacecraft Navigation Based on Pulsar Timing Information," 2011 2nd *International Conference on Space Technology* (*ICST*), Sep. 15-17, 2011, Athens, Greece; 4 pages.

Dana, P. H. et al. (Jul./Aug. 1990). "The Role of GPS in Precise Time and Frequency Dissemination," *GPSWorld*, 8 pages.

Defraigne, P. et al. (2008). "GPS Time and Frequency Transfer: PPP and Phase-Only Analysis," *International Journal of Navigation and Observation*, vol. 2008, 8 pages.

Fisher, PhD., Maj. K. A. et al. (Summer 2011). "Precision Position, Navigation, and Timing without the Global Positioning System," *Air & Space Power Journal*, pp. 24-33.

Hewlett Packard. "GPS and Precision Timing Application," *Application Note 1272*, 28 pages.

Holm, R. et al. (2012). "Microsecond Timing in Smart Grid Substations: Why it is essential and how to achieve it," *UTC Journal*, pp. 27-29, 33.

Kolodziej, K. et al. "In-Building Positioning: Modeling Location for Indoor World," *Proceedings of the 15th International Workshop on Database and Expert Systems Applications*, Aug. 30-Sep. 3, 2004; pp. 830-834.

Leung, I. (Jun. 2012). "GPS alternative leverages other signals for navigation," located at http://www.electronicsnews.com.au/news_visited_on_April_17, 2015. (3 pages).

National Institute of Standards and Technology, Physics Laboratory: Time & Frequency Division. "Two Way Time Transfer," located at http://tf.nist.gov/time/twoway.htm_visited_on_January_30, 2015, (2 pages).

Pappalardi, F. et al. "Alternatives to GPS," *An Ocean Odyssey Conference Proceedings*, Nov. 5-8, 2001, Honolulu, HI; pp. 1452-1459.

The United States Government. "Global Positioning System Standard Positioning Service Signal Specification," *GPS Naystar: Global Positioning System*, Jun. 2, 1995, 2nd Edition, 51 pages.

Lin, S. et al. "The Comparison Between TWSTFT and GPS Time Transfer Result of PTB-TL Link," *2009 IEEE International Frequency Control Symposium Joint with the 22nd European Frequency and Time forum*, Apr. 20-24, 2009, Besancon, France; pp. 1203-1205.

* cited by examiner

ROBUST AND RESILIENT TIMING ARCHITECTURE FOR CRITICAL INFRASTRUCTURE

FIELD OF THE INVENTION

The present disclosure relates generally to providing synchronized timing, and more specifically to providing robust and resilient timing with high accuracy and precision.

BACKGROUND OF THE INVENTION

Critical infrastructure—assets, systems, and networks, whether physical or virtual, that are so vital to the functioning of a society that their incapacitation would have a debilitating effect on security, national economic security, national public health, or safety—such as power grid systems, transportation systems, banking operations, and communication systems rely on highly accurate and precise timing that is synchronized to Coordinated Universal Time (UTC). For example, power grids rely on synchronized timing to enable various distributed devices, such as protection relays, phasor measurement units, merging units, event recorders, fault detectors, and control consoles, to stay synchronized to each other and UTC with plus or minus 1 microsecond accuracy. As another example, communications systems, which strive for faster data rates, must achieve a low Bit Error Rate (BER), which requires highly accurate network synchronization. The frequencies at each node in the communication system have to be maintained more closely, more accurately, and with less drift in order to push data rates higher. Wireless broadband LTE-A communication systems require plus or minus 1.5 microsecond accuracy to UTC. Banking communications networks must maintain timing synchronization of data encryption and decryption equipment and for high speed transactions.

Global Navigation Satellite Systems (GNSS) such as the U.S. NAVSTAR Global Positioning System (GPS), the European Galileo positioning system, and the Russian GLONASS system are increasingly relied upon to provide synchronized timing that is both accurate and reliable. (Reference is made to GPS below, by way of example and simplicity, but similar characteristics and principles of operation apply to other GNSS.) GPS provides highly accurate and precise timing around the world, and the equipment needed to receive and use GPS signals is widely available and cheap, allowing for timing signals to be received at many diverse locations. As shown in FIG. 1B, critical infrastructure such as power grid systems, transportation systems, banking operations, and communications systems all depend on GPS time reference. GPS is a constellation of twenty-four satellites, eighteen active, and six ready spares that orbit the earth in polar, equatorial, and diagonal orbits. The twenty-four satellites that make up the GPS network provide space-based positioning, navigation, and timing, which includes the distribution of precise time and precise time of day. As illustrated in FIG. 1A, GPS receivers simultaneously receive GPS signals from a number of satellites in the constellation. These receivers use the information contained in the signals to provide network synchronization, location, and navigation. The GPS network also includes earth based performance monitoring stations that constantly measure the time signals from each satellite as each satellite passes over a controlled site. These monitoring stations then send clock corrections back to an individual satellite if and when necessary.

A GPS signal is a direct sequence spread spectrum signal. The signal available for commercial use is that associated with Standard Positioning Service and utilizes a direct sequence bi-phase spreading signal with a 1.023 MHz spread rate placed upon a carrier at 1575.42 MHz (L1 frequency). Each GPS satellite transmits a unique pseudo-random noise (PN) code which identifies the particular satellite, and allows signals simultaneously transmitted from several satellites to be simultaneously received by a receiver, with little interference from one another. The pseudo-random noise code sequence length is 1023 chips, corresponding to 1 millisecond time period. One cycle of 1023 chips is called a PN frame. Thus, each received GPS signal in C/A (coarse acquisition) mode is constructed from the high rate 1.023 MHz repetitive PN pattern of 1023 chips. At very low received signal levels, the pseudo random pattern may be tracked, or otherwise used, to provide ambiguous system timing by processing many PN frames (e.g., 1000 repetitions over 1 second). A GPS receiver knows the PN codes of satellites in the constellation and may lock into a given GPS satellite by generating and shifting its code until the generated code lines up with the received code. The amount of shift along with knowledge of the distance to a GPS satellite enables the receiver to determine timing synchronized to the GPS satellite. In this process, the GPS receiver essentially measures the start times of PN frames for a multiplicity of received GPS signals.

Superimposed on the 1.023 MHz PN code is a low rate signal. This 50 Hz signal is a binary phase shift keyed (BPSK) data stream with bit boundaries aligned with the beginning of a PN frame. There are exactly 20 PN frames per data bit period (20 milliseconds). The 50 Hz signal modulates a Navigation Message which consists of data bits describing the GPS satellite locations, clock corrections, time-of-week information, and other system parameters. The absolute time associated with the satellite transmissions are determined in conventional GPS receivers by reading data contained within the Navigation Message of the GPS signal. In the standard method of time determination, a conventional GPS receiver decodes and synchronizes the 50 baud data bit stream (the 50 Hz BPSK data stream). The 50 baud signal is arranged into 30-bit words grouped into subframes of 10 words, with a length of 300 bits and a duration of six seconds. Five subframes comprise a frame of 1500 bits and a duration of 30 seconds, and 25 frames comprises a superframe with a duration of 12.5 minutes. The data bit subframes which occur every six seconds contain bits that provide the Time of Week to six second resolution. The 50 baud data stream is aligned with the C/A code transitions so that the arrival time of a data bit edge (on a 20 millisecond interval) resolves the absolute transmission time to the nearest 20 milliseconds. Precision synchronization to bit boundaries can resolve the absolute transmission time to less than a millisecond.

GPS time is steered to within one microsecond of UTC, with the exception of an integer number of leap seconds, which are added to UTC time but not to GPS time. The Navigation Message includes the offset between the GPS time and UTC time to a precision of 90 nanoseconds. Time intervals can be produced by a receiver using the 1 millisecond repetition rate of the PN code. Each millisecond of GPS satellite time can be time tagged by extracting the week number and time of week count from the standard GPS navigation message. Reference frequencies may be established by a GPS receiver by disciplining an oscillator using integrated code-phase measurements or by directly measuring the GPS satellite carrier frequency.

Using the above methods, GPS receivers can provide the highly accurate and precise timing required by critical infrastructure. However, dependence on GPS may be problematic for critical infrastructure. Dependence creates a single point of failure in which the loss of GPS signals could result in a serious operational disruption. GPS signals are vulnerable to a range of environmental and intentional disruptions. For example, geomagnetic storms may disrupt or distort GPS signals, which are relatively weak and, therefore, subject to geomagnetic radiation. Furthermore, GPS signals can be intentionally jammed or spoofed. GPS jammers, which generally transmit narrowband Gaussian noise signals near the L1 frequency, are cheap and widely available and can prevent receivers from acquiring GPS signals. GPS spoofers may broadcast counterfeit GPS signals containing misinformation causing receivers to generate incorrect timing information. Many conventional systems relying on GPS include atomic clocks that may be used to "holdover" while a GPS signal is down. However, reliance on these clocks for extended periods can cause increasingly inaccurate timing.

Accordingly, there is a need for a robust and resilient timing source for critical infrastructure that does not rely on GPS but still provides accurate synchronized timing to a wide geographic area.

BRIEF SUMMARY OF THE INVENTION

Described herein are systems, methods, and devices for transmitting timing information independent of GNSS (e.g., GPS). These systems, methods, and devices may provide GNSS-independent accurate timing to critical infrastructure. Such systems, methods, and devices may provide greater signal power than GPS and greater security than GPS. According to certain embodiments, systems, methods, and devices are able to deliver synchronized timing information to critical infrastructure with 1 microsecond accuracy. The systems, methods, and devices described herein can provide the highly accurate and precise timing synchronized to UTC that is required by power grid systems, transportation systems, banking operations, and communication systems.

According to certain embodiments, a system distributes synchronized timing information derived from a GNSS-independent source using radio signals. The timing information is synchronized to a time standard, and the system maintains a level of synchronization accuracy required by critical infrastructure. The radio signals are broadcast from one or more transmitters distributed throughout a geographic area. Receivers that may be located at critical infrastructure locations receive the radio signals from one or more transmitters and extract synchronized timing information. The receivers can generate time, timing, and frequency reference information synchronized to the time standard and transmit the reference information to critical infrastructure.

According to certain embodiments, a system distributes synchronized timing by broadcasting Frequency Modulation (FM) band radio signals. According to certain embodiments, the communication of the synchronized timing using FM radio signals can employ communication techniques similar to those used in GNSS systems. A transmitter modulates digital information on a carrier signal. The digital information includes a unique pseudorandom code allowing a receiver to acquire a transmitter's signal. The digital information also includes components similar to a GNSS Navigation Message, which may include transmitter location, clock corrections, time-of-week information, information about other transmitters, and other system parameters. According to certain embodiments, the use of GNSS-like signals enables receivers to use off the shelf GPS receiver components.

The signal strength of the FM radio signals is higher than GPS signal strengths, and therefore, the FM radio signals are less vulnerable to environmental disruptions. Furthermore, FM radio signals may be received inside buildings, where GNSS signals cannot be detected. This allows synchronized timing to be received at critical infrastructure locations without access to GPS signals, such as in-building 4G microcells. According to certain embodiments, dual-band FM radio signals are transmitted to mitigate dispersion effects of the atmosphere. According to certain embodiments, the data transmitted using the FM radio signals is encrypted to mitigate spoofing.

According to certain embodiments, a device for transmitting synchronized timing includes a receiver, a transmitter, one or more processors, memory, and one or more programs, wherein the one or more programs are stored in the memory and configured to be executed by the one or more processors, the programs including instructions for receiving through the receiver a timing signal comprising first time information that is synchronized to a time standard, determining second time information based at least partially on the first time information, composing a message formatted in accordance with a global navigation satellite system (GNSS) standard, wherein the message comprises the second time information, and transmitting the message through the transmitter on a radio signal having a frequency in the frequency modulation (FM) radio frequency band.

In any of the embodiments the time standard may be Coordinated Universal Time (UTC). In any of the embodiments the synchronization of the first time information to the time standard may be accurate to within 10 nanoseconds. In any of the embodiments the first time information may be independent of a GNSS. In any of the embodiments the receiver may be configured to receive the timing signal over fiber optic cable from a ground-based time transmitter. In any of the embodiments the second time information may be synchronized to the time standard and the synchronization is accurate to within 500 nanoseconds. In any of the embodiments the message may further include information based on a location of the device. In any of the embodiments the transmitter may be configured to simultaneously transmit the message on two radio signals having frequencies in the FM radio frequency band. In any of the embodiments the programs may include instructions for encrypting the message prior to transmitting the message through the transmitter. In any of the embodiments the message may include at least one of a pseudorandom noise code, time-of-week information, and clock correction information.

According to certain embodiments, a method includes at an electronic device with a processor, a receiver, and a transmitter, receiving through the receiver a timing signal comprising first time information that is synchronized to a time standard, determining second time information based at least partially on the first time information, composing a message formatted in accordance with a GNSS standard, wherein the message comprises the second time information, and transmitting the message through the transmitter on a radio signal having a frequency in an FM radio frequency band.

In any of the embodiments the time standard may be UTC. In any of the embodiments the synchronization of the first time information to the time standard may be accurate to within 10 nanoseconds. In any of the embodiments the first time information may be independent of a GNSS. In any of the embodiments the receiver may be configured to receive the timing signal over fiber optic cable from a ground-based time transmitter. In any of the embodiments the second time information may be synchronized to the time standard and the synchronization is accurate to within 500 nanoseconds. In any of the embodiments, the message may further include information based on a location of the device. In any of the embodiments, the transmitter may be configured to simultaneously transmit the message on two radio signals having frequencies in the FM radio frequency band. In any of the embodiments, a method may further include encrypting the message prior to transmitting the message through the transmitter. In any of the embodiments the message may include at least one of a pseudorandom noise code, time-of-week information, and clock correction information.

According to certain embodiments, a receiving device includes a receiver, a transmitter, one or more processors, memory, and one or more programs, wherein the one or more programs are stored in the memory and configured to be executed by the one or more processors, the programs including instructions for receiving through the receiver a radio signal having a frequency in an FM radio frequency band, the radio signal comprising a message formatted in accordance with a GNSS standard, extracting first time information from the message, determining second time information based at least partially on the first time information, wherein the second time information is synchronized to a time standard, generating a timing signal based at least partially on the second time information, and transmitting the timing signal through the transmitter.

In any of the embodiments the synchronization of the second time information may be accurate to within 10 microseconds relative to the time standard. In any of the embodiments the receiver may be configured to simultaneously receive two radio signals having frequencies in an FM radio frequency band. In any of the embodiments the programs may include instructions for decrypting the message. In any of the embodiments the message may comprise at least one of a pseudorandom noise code, time-of-week information, and clock correction information. In any of the embodiments the receiving device may include a second receiver configured to receive a GNSS signal and determine a GNSS time information from the GNSS signal, and may further include instructions for detecting one or more errors in the radio signal and the GNSS signal, and generating the timing signal based at least partially on the second time information when a GNSS signal error is detected and at least partially on the GNSS time information when a radio signal error is detected.

According to certain embodiments, a receiving method includes at an electronic device with a processor, a receiver, and a transmitter, receiving through the receiver a radio signal having a frequency in the FM radio frequency band, the radio signal comprising a message formatted in accordance with a GNSS standard, extracting first time information from the message, determining second time information based at least partially on the first time information, wherein the second time information is synchronized to a time standard, generating a timing signal based at least partially on the second time information, and transmitting the timing signal through the transmitter.

In any of the embodiments the synchronization of the second time information may be accurate to within 10 microseconds relative to the time standard. In any of the embodiments the receiver is configured to simultaneously receive two radio signals having frequencies in an FM radio frequency band. In any of the embodiments, the method may include decrypting the message. In any of the embodiments the message may include at least one of a pseudorandom noise code, time-of-week information, and clock correction information. In any of the embodiments, the method may further comprise a second receiver configured to receive a GNSS signal and determine a GNSS time information from the GNSS signal, and the method may further include instructions for detecting one or more errors in the radio signal and the GNSS signal, and generating the timing signal based at least partially on the second time information when a GNSS signal error is detected and at least partially on the GNSS time information when a radio signal error is detected.

According to certain embodiments, a non-transitory computer readable storage medium stores one or more programs, the one or more programs comprising instructions, which when executed by an electronic device with a receiver and a receiver and a transmitter, cause the device to receive through the receiver a radio signal having a frequency in the FM radio frequency band, the radio signal comprising a message formatted in accordance with a GNSS standard, extract first time information from the message, determine second time information based at least partially on the first time information, wherein the second time information is synchronized to a time standard, generate a timing signal based at least partially on the second time information, and transmit the timing signal through the transmitter.

According to certain embodiments, a system comprises a transmitting unit comprising a first receiver, a first transmitter, one or more first processors, first memory, and one or more first programs, wherein the one or more first programs are stored in the first memory and configured to be executed by the one or more first processors, the first programs including instructions for receiving through the first receiver a first timing signal comprising first time information that is synchronized to a time standard, determining second time information based at least partially on the first time information, composing a message formatted in accordance with a GNSS standard, wherein the message comprises the second time information, and transmitting the message through the first transmitter on a radio signal having a frequency in an FM radio frequency band, and a receiving unit comprising a second receiver, a second transmitter, one or more second processors, second memory, and one or more second programs, wherein the one or more second programs are stored in the second memory and configured to be executed by the one or more second processors, the second programs including instructions for receiving through the second receiver the radio signal, extracting the second time information from the message transmitted on the radio signal, determining third time information based at least partially on the second time information, wherein the third time information is synchronized to the time standard, generating a second timing signal based at least partially on the third time information, and transmitting the second timing signal through the second transmitter.

In any of the embodiments the third time information may be synchronized to the time standard with an accuracy of within 10 microseconds.

According to certain embodiments, a system includes a receiving module that includes a receiver, a first transmitter, one or more first processors, first memory, and one or more first programs, wherein the one or more first programs are stored in the first memory and configured to be executed by the one or more first processors, the first programs including instructions for receiving through the receiver a radio signal having a frequency in the FM radio frequency band, the radio signal comprising a message formatted in accordance with a GNSS standard, extracting first time information from the message, determining second time information based at least partially on the first time information, wherein the second time information is synchronized to a time standard, generating a first timing signal based at least partially on the second time information, and transmitting the first timing signal through the first transmitter, a GNSS module configured to receive a GNSS signal and transmit a GNSS timing signal based at least partially on the GNSS signal, and a management module that includes a second transmitter, one or more second processors, second memory, and one or more second programs, wherein the one or more second programs are stored in the second memory and configured to be executed by the one or more second processors, the second programs including instructions for detecting one or more errors in the radio signal and the GNSS signal, and transmitting a second timing signal, wherein the second timing signal is based at least partially on the first timing signal in accordance with detecting an error in the GNSS signal and at least partially on the GNSS timing signal in accordance with detecting an error in the radio signal.

In any of the embodiments the one or more errors comprises low signal strength or loss of signal.

DETAILED DESCRIPTION OF THE INVENTION

Figure 1A:
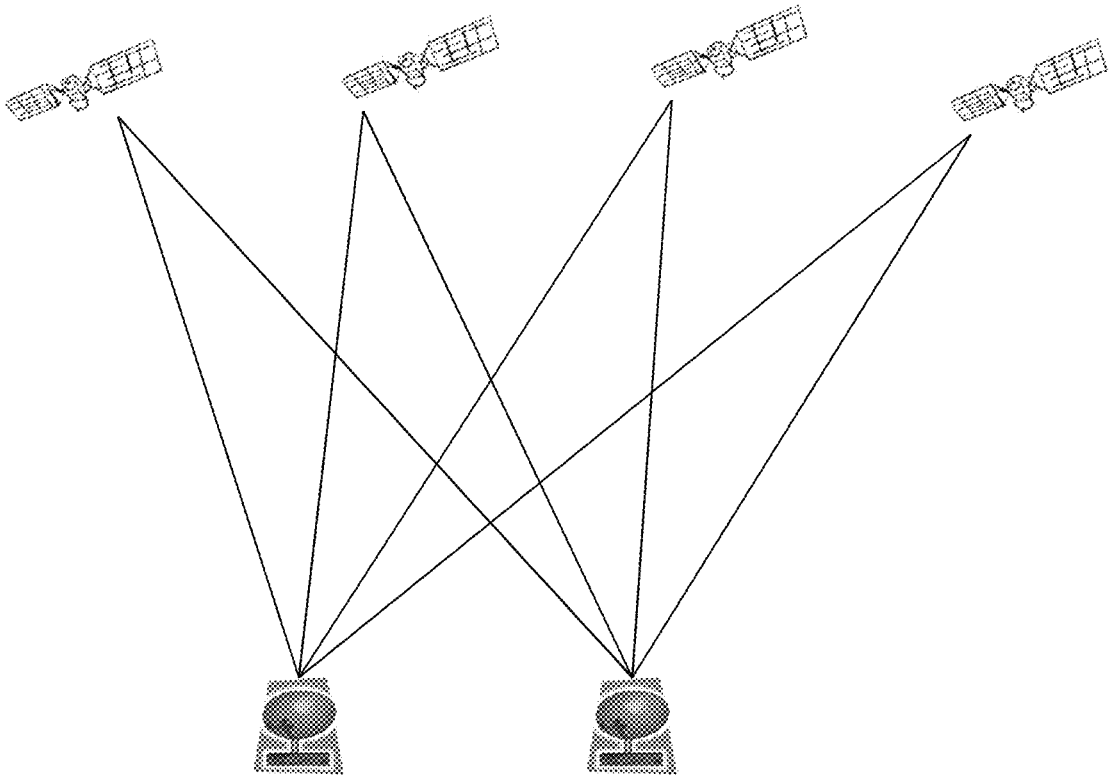
FIG. 1A is an illustration of a Global Navigation Satellite System.
Figure 1B:
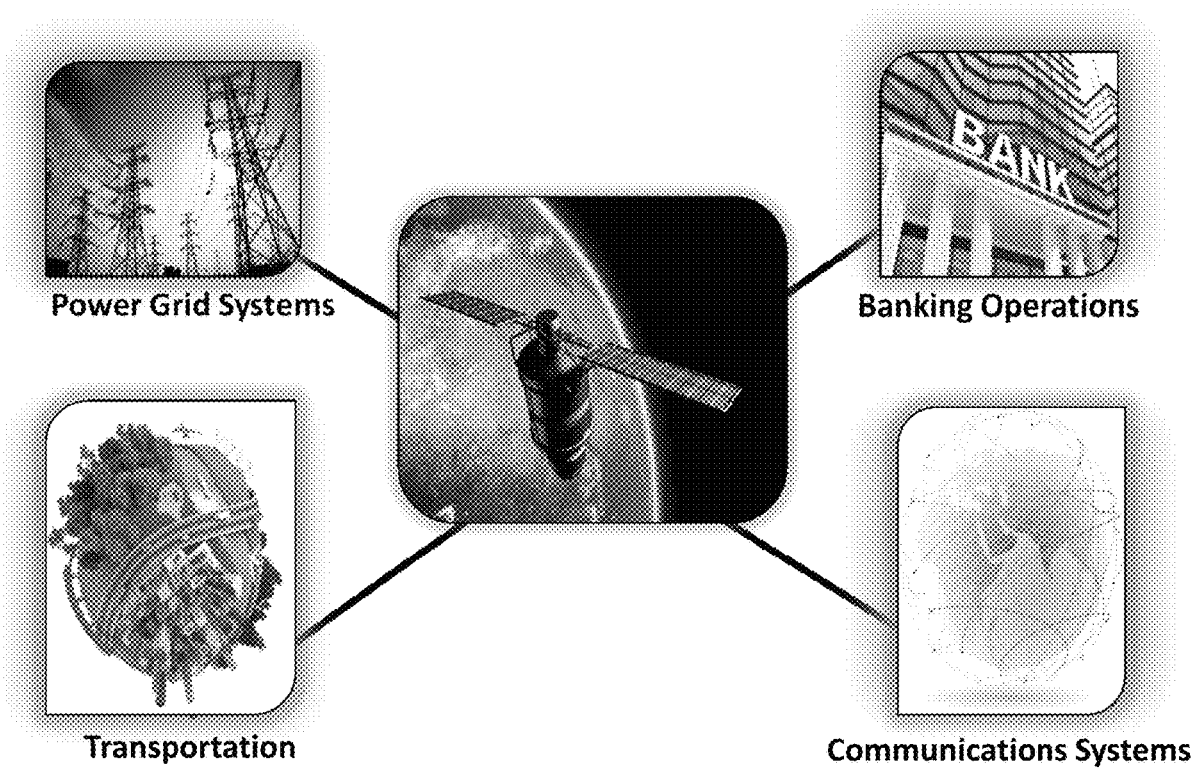
FIG. 1B is an illustration of a the dependence of critical infrastructure on Global Navigation Satellite Systems.

In the following description of the disclosure and embodiments, reference is made to the accompanying drawings in which are shown, by way of illustration, specific embodiments that can be practiced. It is to be understood that other embodiments and examples can be practiced and changes can be made without departing from the scope of the disclosure.

In addition, it is also to be understood that the singular forms "a," "an," and "the" used in the following description are intended to include the plural forms as well, unless the context clearly indicates otherwise. It is also to be understood that the term "and/or" as used herein refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm, a method, or a process. It should be noted that the process steps and instructions of the present invention could be embodied in software, firmware or hardware, and when embodied in software, could be downloaded to reside on and be operated from different platforms used by a variety of operating systems.

The present invention also relates to a device for performing the operations herein. This device may be specially constructed for the required purposes, or it may comprise a general-purpose computer selectively activated or reconfigured by a computer program stored in the computer. Such a computer program may be stored in a non-transitory computer readable storage medium, such as, but not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), field-programmable gate arrays (FPGA), or any type of media suitable for storing electronic instructions, and each coupled to a computer system bus. Furthermore, the computers referred to in the specification may include a single processor or may be architectures employing multiple processor designs for increased computing capability.

Described herein are embodiments of methods, systems, and devices for distributing synchronized timing information using radio signals. According to certain embodiments, a system distributes synchronized timing information derived from a GNSS-independent reference that provides high accuracy synchronization to a time standard, such as UTC. The system can deliver to critical infrastructure a high level of synchronization accuracy and thus serve as a replacement for or backup to GNSS. The system generates digital data containing information required to distribute accurate timing and modulates the data on radio frequency carrier signals using techniques developed for and used in GNSS. Use of these techniques can enable the use off-the-shelf GNSS components.

Systems, methods, and devices, according to certain embodiments, distribute synchronized timing information by broadcasting radio signals in the FM radio frequency band. It is understood that the FM radio band is dictated by government and may be different from country to country and may be increased or decreased over time. As used herein, a radio signal having a frequency in the FM radio frequency band is a radio signal with a carrier frequency from 80 to 120 MHz. According to certain embodiments, synchronized timing is distributed by broadcasting an FM radio signal with a carrier frequency from 87.8 MHz to 108.0 MHz, in accordance with the current designation in the United States. According to certain embodiments, synchronized timing is distributed by broadcasting a radio signal with a carrier frequency in the Very High Frequency range from 30 to 300 MHz. According to certain embodiments, synchronized timing is distributed by broadcasting a radio signal with a carrier frequency in the low frequency band from 30-300 kilo-Hertz (kHz), in a medium frequency band from 300-3000 kHz, in a high frequency band from 3-30 MHz, or in an ultra high frequency band from 300-3000 MHz.

According to certain embodiments, FM radio signals are broadcast from one or more transmitters distributed throughout a geographic area. Receivers located at critical infrastructure locations receive the FM radio signals from one or more transmitters and extract synchronized timing information. The receivers can generate time, timing, and frequency reference information synchronized to the time standard and transmit the reference information to critical infrastructure installation. The use of FM radio signals enables a single transmitter to feed multiple receiving units. For example, a signal transmitter may serve an entire city. Furthermore, because FM radio signal strength is higher than GNSS signal strength, environmental threats to timing distribution by FM are less than those to timing distribution by GNSS. Moreover, receivers may be located inside buildings where GNSS signals do not penetrate.

Timing Distribution System

According to certain embodiments, a system can distribute synchronized timing information derived from a GNSS-independent source by broadcasting radio signals. The timing information is synchronized to a time standard, and the system maintains a level of synchronization accuracy required by critical infrastructure. The radio signals are broadcast from one or more transmitters distributed throughout a geographic area. Receivers that may be located at critical infrastructure installations receive the broadcast radio signals from one or more transmitters and extract synchronized timing information. The receivers can generate time, timing, and frequency reference information synchronized to the time standard and transmit the reference information to critical infrastructure.

Figure 2:
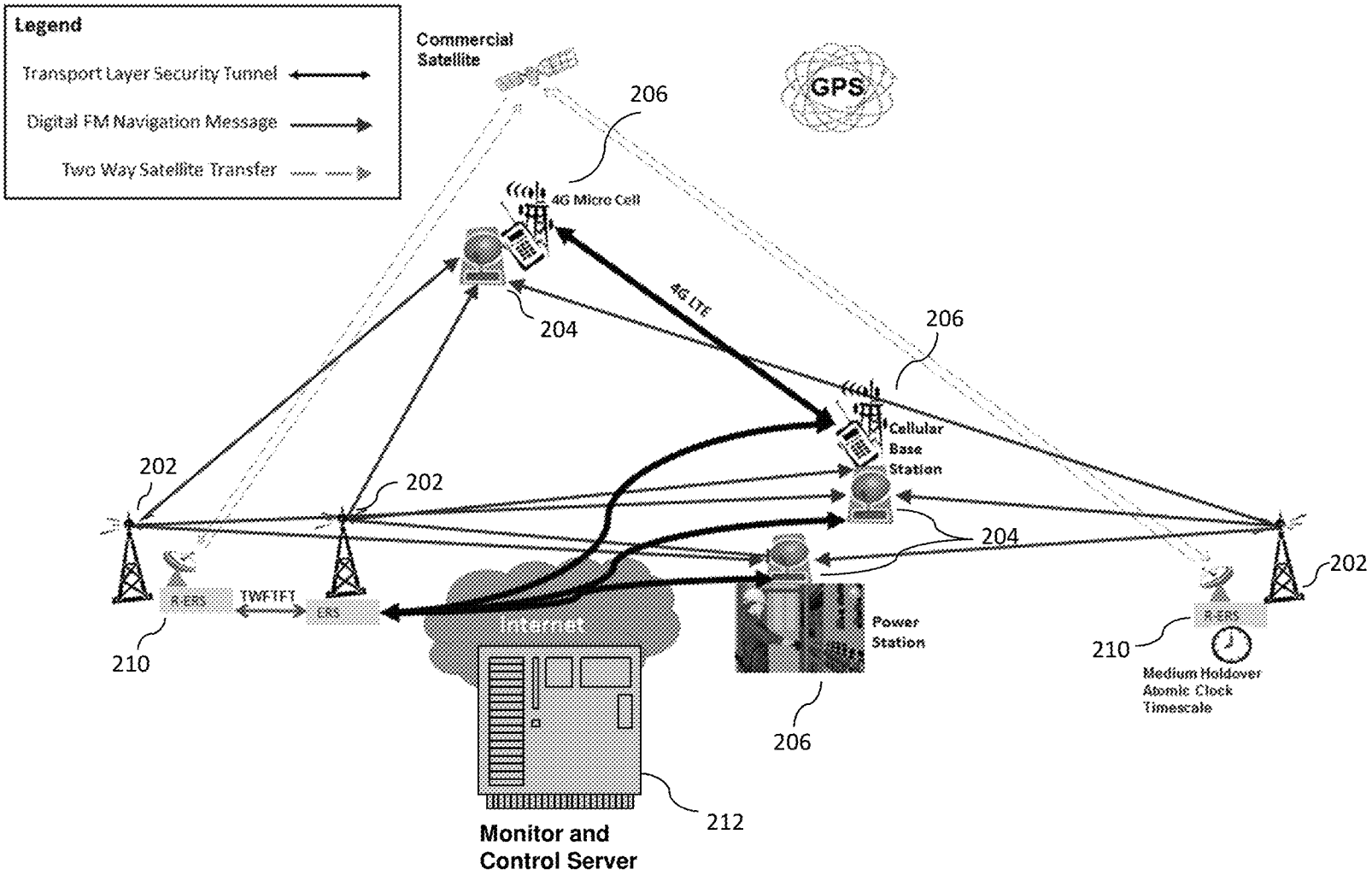
FIG. 2 is an illustration of a system for distributing synchronized timing according to certain embodiments.

FIG. 2 is a system 200 according to certain embodiments. System 200 includes one or more transmitting units 202 and one or more receiving units 204. Transmitting unit 202 transmits timing information that is synchronized to a time standard to one or more receiving units 204 using FM radio signals. Receiving units 204 may be located at end-user systems and devices 206, such as critical infrastructure installations, that depend on receiving reliable timing information. Receiving units 204 generate the timing information needed by the critical infrastructure locations based on the timing information received from one or more transmitting units 202. Transmitting unit 202 transmits timing information independent of a GNSS system, and therefore, is not affected by a GNSS system failure. Accordingly, receiving unit 204 may continue to receive accurate timing information during GNSS failure. Furthermore, threats to GNSS such as loss of signal, GNSS jamming, and GNSS spoofing do not affect the timing information generated and provided to the critical infrastructure locations. Additionally, because FM radio signals may be received at locations without line of sight to the sky (and, thus, GNSS satellites), receiving units 204 may be located at critical infrastructure locations where GNSS receivers may be ineffective. Accordingly, receiving units 204 can provide reliable timing information to critical infrastructure locations independent of GNSS.

According to certain embodiments, transmitting unit 202 receives reference timing information that is synchronized to a time standard (e.g., UTC) with an accuracy of within 10 nanoseconds. Transmitting unit 202 can transmit timing information synchronized to the time standard with an accuracy of within 1 millisecond and precision of within 100 nanoseconds based on the received reference timing. Based on receiving the transmitted timing information from transmitting unit 202, receiving unit 204 can generate timing information with 10 microsecond accuracy to the time standard. According to certain embodiments, transmitting unit 202 can transmit timing information with 100 nanosecond accuracy or better and 10 nanosecond precision or better. Based on receiving this timing information, receiving unit 204 can generate timing information with 1 microsecond accuracy to the time standard or better, thus meeting the requirements of many critical infrastructure systems.

Transmitting unit 202 broadcasts digital radio signals containing timing information. According to certain embodiments, transmitting unit 202 broadcasts digital radio signals containing timing information in a low frequency band from 30-300 kHz, in a medium frequency band from 300-3000 kHz, in a high frequency band from 3-30 MHz, in a very high frequency band from 30 to 300 MHz, or in an ultra high frequency band from 300-3000 MHz. According to certain embodiments, transmitting unit 202 broadcasts digital radio signals containing timing information in an Amplitude Modulation (AM) band, a cellular communication band, or a wireless broadband band. According to certain embodiments, transmitting unit 202 broadcasts digital FM radio signals with carrier frequencies at or near 100 MHz. Transmitting unit 202 may include a radio broadcast antenna or be located near a radio broadcast antenna to broadcast the timing information over a wide area. In some embodiments, the broadcast signal is a high power signal enabling wide geographic reach and or deep penetration into buildings. For example, the signal may be broadcast with power in the 4 kiloWatt (kW) to 40 kW range. According to certain embodiments, the transmitted signal power may be higher than 40 kW. This allows a single transmitting unit 202 to provide timing to multiple receiving units 204 distributed over a wide area. For example, the signal broadcast by transmitting unit 202 may be receivable up to 150 kilometers away. Transmitting unit 202 transmits a digital signal, which requires less power to be received within a given range. Digital FM signals offer data transmission rates of 64 to 128 kilobits per second (kbps). According to certain embodiments, the data rate is higher than 128 kbps, such as 256 kbps or 512 kbps. According to certain embodiments, system 200 may include multiple transmitting units 202 with varying levels of power. For example, one or more transmitting units 202 may transmit at relatively high power while the other transmitting units 202 transmit at a relatively lower power. In certain embodiments, transmitting unit 202 transmits a dual band digital signal to moderate dispersion effects caused by atmospheric interference with radio signal propagation. Because dispersion is a function of frequency, dual band allows for frequency dispersion to be computed. Specifically, the dispersion coefficient can be deduced from the time delay between the two known frequencies.

The timing information transmitted by transmitting units 202 is synchronized to a time standard. For example, timing information may be synchronized to UTC or International Atomic Time. According to certain embodiments, the time standard is a time standard specific to the user of the timing information. For example, a critical infrastructure system may operate on its own specific timing standard and system 200 is configured to transmit, receive, and generate timing information synchronized to the specific timing standard. In other embodiments, the standard is a regional standard (e.g., defined by a local government).

Transmitting unit 202 transmits the timing information in digital data formatted in accordance with a GNSS standard and modulated on a radio frequency carrier signal. In some embodiments, the radio frequency carrier signal has a frequency in the FM band. In certain embodiments, transmitting unit 202 transmits a unique pseudorandom bit sequence (PRBS) (e.g., similar to a GPS PN code) at a first frequency combined with a stream of data at a second frequency that can include information describing transmitting unit locations, clock corrections, time-of-week information, and other system parameters.

Receiving unit 204 receives the broadcast radio signal with the modulated data from one or more transmitting units 202 and extracts the timing information in a manner similar to that employed by standard GPS receivers. Receiving unit 204 determines the time relative to the time standard using the extracted timing information, knowledge of its own location, and knowledge of the location of transmitting unit 202. In certain embodiments, transmitting unit 202 transmits information about its location in the radio signal and receiving unit 204 uses this information to determine the time relative to the time standard.

In certain embodiments, receiving unit 204 receives messages from multiple transmitting units 202. Receiving unit 204 may use the multiple received messages to generate accurate timing information when receiving unit 204 does not know its own location relative to transmitting units 202. For example, where receiving unit 204 is mobile and its position relative to transmitting unit 202 is not fixed, receiving unit 204 may use messages from multiple transmitting units 202 to calculate its position and generate accurate timing information based on that calculated position. In some embodiments, receiving unit 204 uses the multiple received messages to first determine its position relative to one or more transmitting units 202 and once that has been determined, uses messages from only one transmitting unit 202 to determine the synchronized timing information.

Receiving unit 204 detects the data transmitted by one or more transmitting units 202 based on the unique PRBS code included in each broadcast signal. Similar to GNSS, this enables receiving units 204 to extract the synchronized timing information from the received signal. Furthermore, receiving unit is able to simultaneously receive multiple transmitting unit 202 signals and extract timing information without one signal interfering with another.

Receiving unit 204 can generate timing information for distribution to critical infrastructure based on the information extracted from the received signals. Receiving unit 204 may generate synchronized time, timing, and frequency for use as accurate references by critical infrastructure. For example, receiving unit 204 may communicate one pulse per second timing reference, 10 MHz frequency references, and/or a time code. Receiving unit 204 may have different output depending on the requirements of the critical infrastructure all the while maintaining accuracy and reliability.

In some embodiments, timing information provided by receiving units 204 may be in addition to GNSS-based timing information. That is, the highly accurate timing information generated by receiving unit 204 may be used as a primary source of timing information with GNSS timing information as a backup or may be used as a backup to GNSS-based timing.

The synchronized timing information used in system 200 is derived from ground-based reference station 210. Ground-based reference station 210 may be part of a GNSS-independent synchronized timing distribution system. The distribution system may employ a variety of systems and techniques for maintaining and distributing accurate timing referenced to a time standard. For example, in the United States, the system may communicate with the US Naval Observatory, which maintains the UTC reference clock for the US government. Various methods used by the distribution system may include two-way satellite time and frequency transfer (TWSTFT), in which timing information is accurately exchanged using commercial and/or military satellites, two-way fiber time and frequency transfer (TWFTFT), in which timing information is accurately exchanged over fiber optic networks, and Network Time Protocol (NTP) and Precision Time Protocol (PTP), which are Internet Protocol methods of accurate timing exchange. In some embodiments, ground-based reference station 210 provides accurate timing information that is entirely independent of GNSS. In certain embodiments, ground-based reference station 210 utilizes GNSS as a redundant source of timing information but does not rely on GNSS to generate and communicate synchronized timing. Therefore, ground-based reference station 210 may continue to provide accurate timing information in the event of GNSS failure.

In certain embodiments, ground-based reference station 210 communicates timing information to transmitting unit 202 using a TWFTFT method. In certain embodiments, transfer of accurate timing between the ground-based reference station 210 and transmitting unit 202 using TWFTFT enables transmitting unit 202 to be up to 16 kilometers away from ground-based reference station 210 while maintaining high accuracy to the time standard. In some embodiments, the accuracy is 2 nanoseconds or less to the time standard. In certain embodiments, the accuracy is around 1 nanosecond. In certain embodiments, the accuracy is around plus or minus 1 nanosecond to UTC. In certain embodiments, transmitting unit 202 receives timing information from ground-based reference station 210 via one-way communication over fiber optic cabling. In these embodiments, transmitting unit 202 may be up to 60 kilometers from ground-based reference station 210. Generally, accuracy of the timing information received at transmitting unit 202 can be higher when communicating via TWFTFT than via one-way communication. According to certain embodiments, the communication between ground-based reference station 210 and transmitting unit 202 is encrypted, e.g., using standards-based encryption algorithms, which include Federal Information Processing Standard Publication 140-2 (FIPS 140-2) compliant algorithms, e.g., AES-256. Encryption keys may be stored in public key infrastructure (PKI) non-person entity (NPE) certificates (e.g., X.509). These keys may be used to encrypt the digital TWFTFT flows.

In certain embodiments, transmitting unit 202 is connected to ground-based timing reference station 210 via one or more fiber optic cables. Fiber optic-based communication offers many advantages over copper wire-based communication, such as greater bandwidth, low attenuation and greater distance, better security because light-based communication does not emit electromagnetic radiation as copper wire communication does, and immunity to environmental factors such as heat and electromagnetic interference.

According to certain embodiments, signals transmitted and received by system 200 are encrypted for added security, reducing or eliminating the ability for signal spoofing to be used to disrupt the timing distribution of system 200. In certain embodiments, AES-256 encryption is used with keying over the network (KOTN). According to certain embodiments, system 200 includes monitor and control unit 212, which may communicate with multiple transmitting units 202, receiving units 204, and end-user systems and devices 206. Monitor and control unit 212 monitors system 200 to ensure accurate and precise timing. Monitor and control unit 212 may also manage distribution of encryption keys allowing for frequent key changes to improve security.

According to the described system, accurate time, timing, and frequency reference information may be distributed to critical infrastructure installations. This distribution can be derived from a GNSS-independent source and, therefore, is not vulnerable to GNSS outages or vulnerabilities. A single transmitting unit can broadcast synchronized timing to multiple receivers located throughout critical infrastructure installations enabling such installations to maintain highly accurate timing synchronized to a time standard.

Transmitting Device

According to certain embodiments, a transmitting device receives a reference signal that includes reference timing information synchronized to a time standard. The transmitting device composes a message formatted in accordance with a GNSS standard that includes synchronized timing information based at least partially on the reference timing information. The transmitting device then transmits the message on a radio signal. According to certain embodiments, the transmitted timing information is synchronized to the time standard with accuracy within 500 nanoseconds. The timing information transmitted by the transmitting device may be received and used to provide synchronized timing to critical infrastructure installations.

Figure 3:
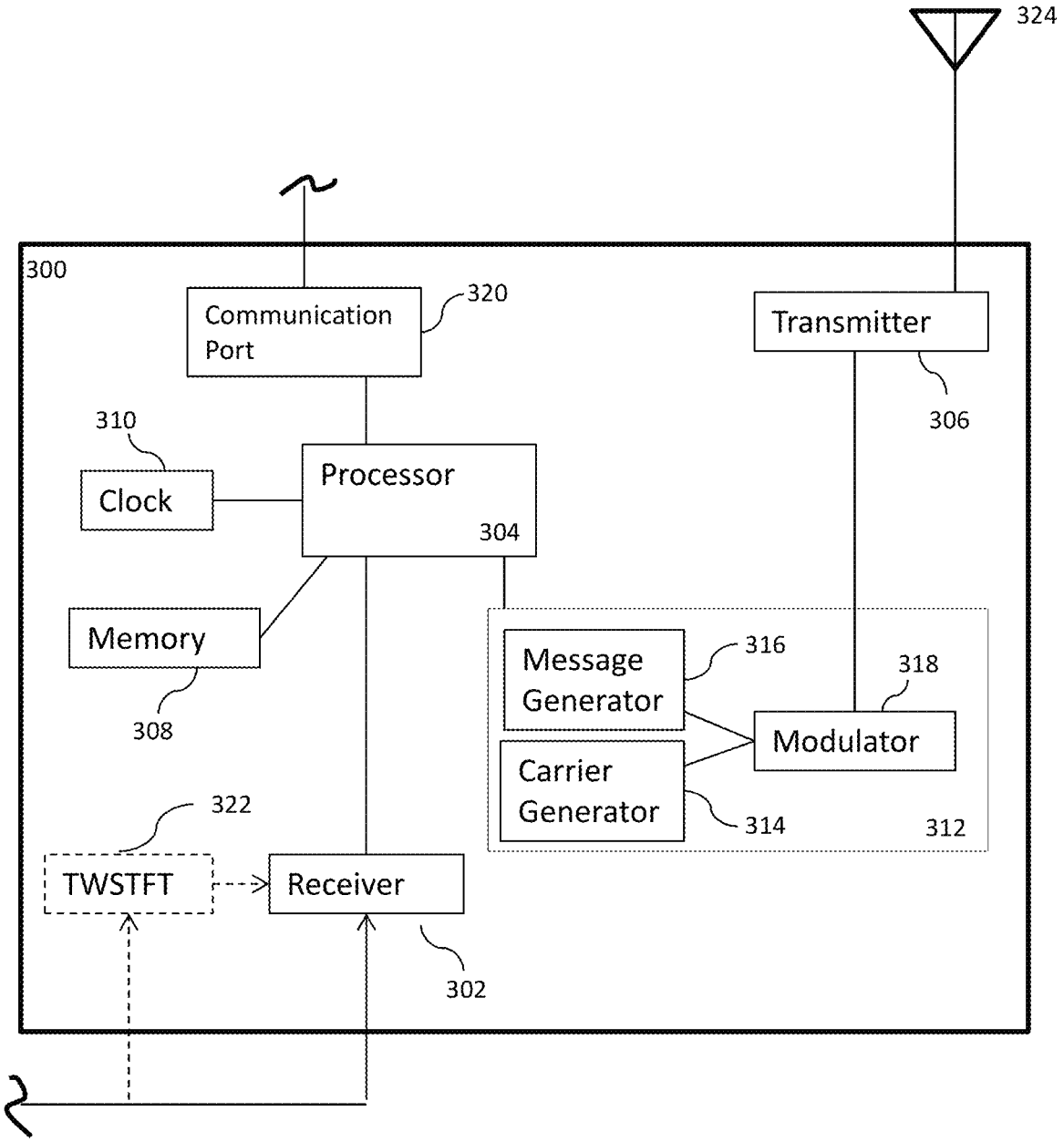
FIG. 3 is an illustration of a device for transmitting synchronized timing according to certain embodiments.

FIG. 3 is an illustration of transmitting device 300 according to certain embodiments. Transmitting device 300 includes receiver 302, processor 304, transmitter 306, and memory 308. In some embodiments, transmitting device 300 includes signal generator 312 and clock 310. These components are functional components whose functions may be performed by discrete devices or by one or more general purpose or special purpose microprocessors such as a digital signal processor. These functions may also be performed by application specific integrated circuits or other dedicated components. Instructions for performing these functions may be included in one or more programs stored in memory 308 that, when executed by processor 304, cause transmitting device 300 to perform the functions described below. According to certain embodiments, a processor may be a general purpose processor or it may be specially selected for performing the below functions.

Receiver 302 receives a signal that includes timing information. Processor 304 processes the received timing information to generate a message formatted in accordance with a GNSS standard. Signal generator 312 generates a signal containing the message and transmitter 306 transmits the message for broadcast from antenna 324.

Receiver 302 receives a signal from a reference timing provider and includes both reference timing and reference frequency information that is synchronized to a time standard. The reference timing may be in the form of a pulse-per-second (pps), for example 1 pps, and the reference frequency may be 1, 2.5, 5, 10, 15, or 20 mega-hertz (MHz). In certain embodiments, the reference frequency is 10 MHz. According to certain embodiments, the reference timing signal includes a series of encoded bits transmitted at 1 pps where the start of the series is synchronized to the start of the reference time. According to certain embodiments, the frequency of the encoded bits is used to determine the reference frequency. According to certain embodiments, the encoded bits encode a message that includes time of day. According to certain embodiments, the reference timing and the reference frequency are phase locked. Receiver 302 may receive the signal through a cable connected to transmitting device 300. In certain embodiments, the cable is a fiber optic cable and the signal is an optical radio frequency signal. Fiber optic communication offers complete electrical isolation, extremely high-speed wideband capability, low signal attenuation, and complete immunity to both noise and broadband spectrum interference, enabling transmitting device 300 to be located some distance from the reference timing provider while still maintaining the integrity of the reference timing information. In certain embodiments, the cable is a conductive metal. Receiver 302 may convert incoming optical radio signals received over the optical fiber to electrical radio signals via one or more optical-to-electrical (O/E) converters, which are then passed on for extraction of the reference timing information.

In certain embodiments, transmitting device 300 includes TWFTFT module 322 that exchanges signals with a reference timing provider located offsite according to known methods. TWFTFT module may be an off-the-shelf component such as a Microsemi ATS-6511. In some embodiments, the timing information contained in the signal received from the reference timing provider is synchronized to a time standard with an accuracy of within 10 nanoseconds. In some embodiments, the timing information is synchronized to UTC with an accuracy of within 100 nanoseconds, within two nanoseconds or under 1 nanosecond. TWFTFT module 322 generates reference time signals and reference frequency signals and transmits the signals to receiver 302. In certain embodiments, TWFTFT module 322 generates a 10 MHz reference frequency and 1 pps reference timing synchronized to UTC. TWFTFT module 322 may transmit to receiver 302 over fiber optic cabling.

Transmitting device 300 determines timing information based on the reference timing and reference frequency received from the reference timing provider or TWFTFT module 322. In certain embodiments, transmitting device 300 uses the reference timing and reference frequency to discipline clock 310. That is, the timing and frequency information generated by clock 310 may be corrected using the reference timing and frequency information. Clock 310 may include a high frequency oscillator such as a crystal oscillator (XO), a voltage-controlled crystal oscillator (VCXO), an oven-controlled crystal oscillator (OCXO), or an atomic frequency reference. Atomic frequency references may be, for example, cesium or rubidium atomic frequency references. Atomic frequency references offer higher accuracy and stability over crystal oscillators allowing for longer holdover times in the event that reference signals from the reference timing provider are interrupted. According to certain embodiments, clock 310 is a rubidium clock. According to certain embodiments, clock 310 is a cesium clock allowing for up to 4 months of holdover.

Transmitting device 300 composes a message that includes the timing information determined based on clock 310. The message is formatted in accordance with a standard GNSS message. For example, according to certain embodiments, the message is formatted in accordance with a standard GPS message. Methods of formatting GNSS messages are known in the art and briefly summarized above with respect to GPS. According to certain embodiments, a message formatted in accordance with a standard GNSS message may include a PRBS code and a navigation message that may include information about time, time of day, and time standard correction factors. In some embodiments, certain portions of a standard GNSS message are not used. For example, satellite ephemeris information and almanac information may not be used. In certain embodiments, almanac information may be included in a message composed by processor 304 to provide calibration information to receivers. Examples of calibration information may be health and status of clock 310, dispersion and ducting characteristics of the FM signal transmission, and other performance aspects of transmitting device 300. In certain embodiments, a message formatted in accordance with a standard GNSS message is modified to account for more frequent transmission times. For example, in certain embodiments, transmitting device 300 transmits the message once per second whereas a standard GPS message is transmitted once every 12.5 minutes. In some embodiments, the message format does not change despite the more frequent transmission times due to the higher data transmission rates of digital FM transmission versus GNSS transmission. Other transmission frequencies are contemplated, including 0.5, 1, 2, and 5 times per second, for example. More frequent transmissions enable faster acquisition of the timing signal by a receiver. For example, according to certain embodiments, within 100 milliseconds, a receiver may acquire synchronized timing information with 10 microsecond accuracy or better from a transmitting device 300 transmitting at 1 pps.

Signal generator 312 generates a signal containing the message composed by processor 304. Signal generator 312 may include carrier signal generator 314, message signal generator 316, and modulator 318. Carrier signal generator 314 generates one or more radio frequency carrier signals used to transmit timing information. According to certain embodiments, a carrier signal generated by carrier signal generator 314 has a frequency in the FM radio frequency band. For example, the carrier signal may have a frequency in the range of 88 to 108 MHz. In certain embodiments, the carrier signal frequency may be between 80 and 120 MHz. In certain embodiments, the carrier signal frequency is above or below a designated FM radio frequency band. For example, the carrier signal frequency may be in a range of 30 MHz to 300 MHz. In some embodiments, carrier signal generator 314 generates two carrier signals at different frequencies. According to certain embodiments, carrier signal generator 314 generates one or more carrier signals using the disciplined frequency generated by clock 310. Carrier signal generator 314 may include one or more frequency dividers and multipliers to generate the carrier frequency based on the disciplined frequency generated by clock 310. According to certain embodiments, carrier signal generator 314 generates a carrier signal with a center frequency of 100 MHz.

According to certain embodiments, message signal generator 316 generates a signal containing the message composed by transmitting device 300. According to certain embodiments, this signal includes a high frequency PRBS code and a low frequency signal containing a navigation message composed by processor 304. Modulator 318 modulates the message signal onto the one or more carrier signals. Modulator 318 may employ various modulation methods according to different embodiments. For example, modulator 318 may employ various digital modulation techniques, including amplitude shift keying, phase-shift keying (such as BPSK or Quadrature PSK), and frequency-shift keying (FSK). In some embodiments, the navigation message is contained in a 50 Hz signal that is a BPSK data stream, superimposed on a 1.023 MHz PRBS code, with bit boundaries aligned with the beginning of a PRBS frame. According to certain embodiments, transmitting device 300 simultaneously transmits different messages on different frequencies. For example, a first message could be used for course acquisition and include a shorter message transmitted more frequently (for example, 5 or 10 times per second) while a second message could be used to transmit a longer message less frequently. This may enable faster acquisition while still allowing for the communication of a full set of information.

The signal generated by signal generator 314 is conditioned and transmitted by transmitter 306. Transmitter 306 may include various signal conditioning components including, but not limited to, filters, amplifiers, and resistors for controlling the signal power and noise characteristics. In certain embodiments, transmitter 306 is configured to provide phase and ducting compensation to improve signal quality. For example, transmitter 306 may accelerate or delay the transmission of a signal to account for dispersion and ducting effects. According to certain embodiments, transmitting device 300 receives information about its signal transmission performance (for example, by receiving timing information from other transmitting devices 300 and/or by receiving information from a monitor and control system through communication port 320) and adjust the signal transmission to compensate for phase and ducting effects. Transmitter 306 transmits the signal to antenna 324 for broadcast. In certain embodiments, the transmitter simultaneously transmits the message on two carrier signals with different frequencies. According to certain embodiments, the carrier frequencies are selected so as to be far enough away from each other that they provide enough separation to accurately characterize dispersion effects while not being so far that the dispersion effects have a nonlinear relationship. The timing information transmitted by transmitter 306 is synchronized to the time standard. In some embodiments, the synchronization accuracy is within 500 nanoseconds of the time standard. In some embodiments, the accuracy is within 100 nanoseconds. In some embodiments, the time standard is UTC and the timing information is synchronized to within 100 nanoseconds of UTC. The timing information transmitted by transmitter 306 has high precision. In some embodiments, the timing information has a precision of within 100 nanoseconds. In some embodiments, the timing information has a precision of within 10 nanoseconds.

In certain embodiments, transmitting device 300 includes an encryption module for encrypting the timing signal prior to broadcasting. The encryption module may be a component of processor 302 or it may be a separate component and the timing information generated by processor 302 may be processed by the encryption module prior to processing by signal generator 312. Various methods of encryption well known in the art may be used such as public key encryption. According to certain embodiments, standards-based encryption algorithms may be used, including FIPS 140-3 compliant algorithms, e.g., AES-256. Encryption keys may be stored in PKI NPE certificates. These keys may be used to encrypt the digital FM navigation messages. These keys may not be the same as keys used to encrypt the TWSTFT communications, as discussed above, and/or monitor and control communications as discussed below with respect to FIG. 8.

Memory 308 stores one or more programs for execution by processor 304. Memory 308 also stores parameters used for generating the timing message, such as the PRBS code, time of day, time of week, time standard (e.g. UTC) clock offsets, constellation information, and transmitter location. Memory 308 may also store other information required by transmitting device 300, such as carrier center frequency values and encryption keys.

In certain embodiments, transmitting device 300 includes communication port 320. Communication port 320 may be used to communicate over wired or wireless communication with a control and/or monitoring system. Communication port 320 may include wired and wireless communication capabilities including, but not limited to, any combination of a Universal Serial Bus (USB) connection, wired Internet, for example a wired local area network (LAN), and/or wireless communication, for example, wireless local area network (WLAN), Global System for Mobile Communications (GSM), Enhanced Data GSM Environment (EDGE), Bluetooth, and Wireless Fidelity (Wi-Fi).

Accordingly, the described transmitting device receives a reference signal that includes reference timing information synchronized to a time standard. The transmitting device composes a message formatted in accordance with a GNSS standard that includes synchronized timing information based at least partially on the reference timing information. The transmitting device transmits the message on a radio signal. According to certain embodiments, the transmitted timing information is synchronized to the time standard with accuracy within 500 nanoseconds. The timing information transmitted by the transmitting device may be received and used to provide synchronized timing to critical infrastructure.

Receiving Device

According to certain embodiments, receiving devices receive radio signals transmitted by transmitting devices, such as transmitting device 300 and generate synchronized timing information for use by critical infrastructure installations. The received radio signals contain messages formatted in accordance with a GNSS standard. Receiving devices extract synchronized time information from the radio signals and generate timing signals based at least partially on that time information and on knowledge of the relative positions of the transmitting devices. The generated timing signals are transmitted to end-user systems and devices, such as critical infrastructure installations, that rely on synchronized timing.

Figure 4:
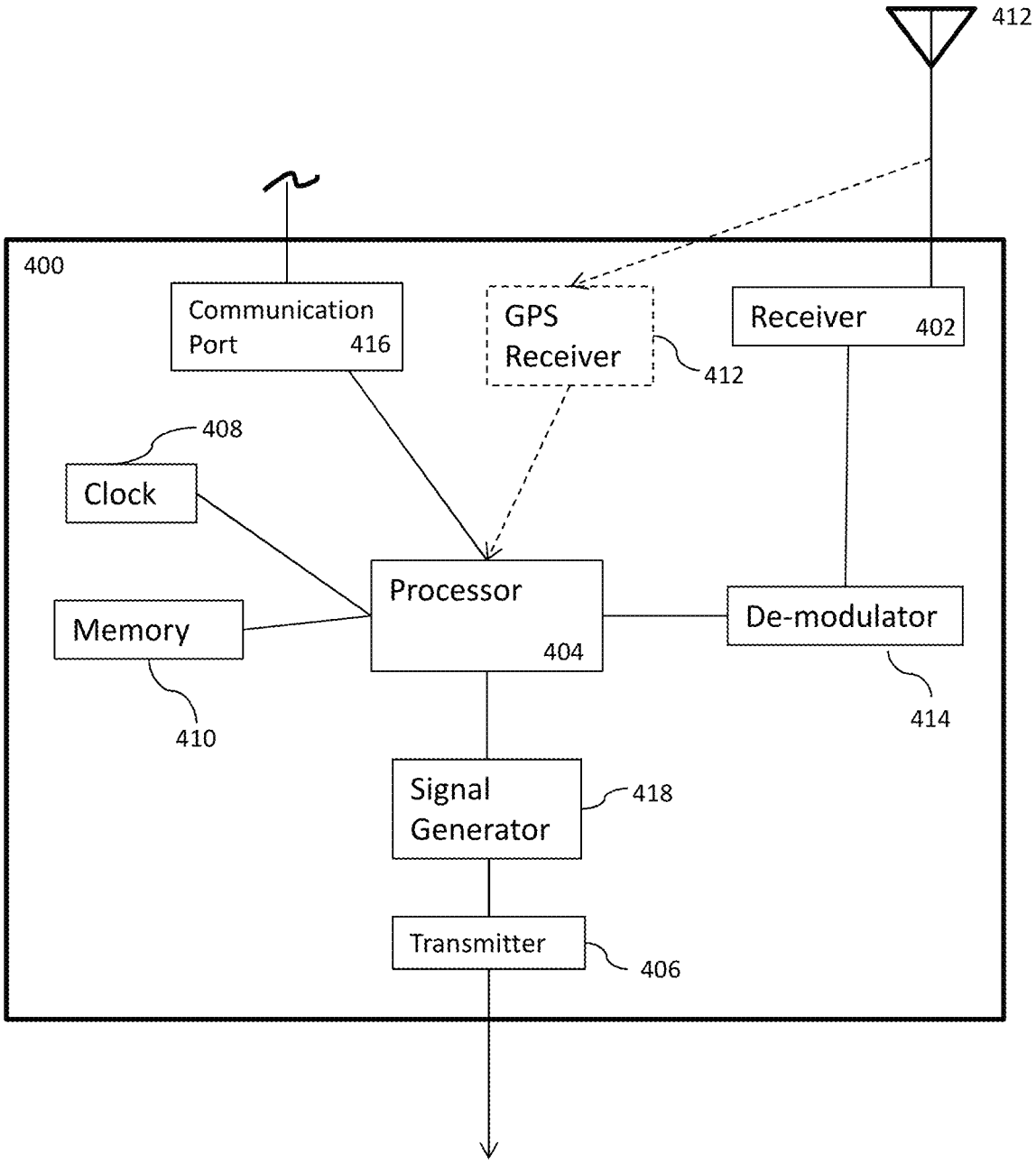
FIG. 4 is an illustration of a receiver for receiving synchronized timing according to certain embodiments.

FIG. 4 illustrates receiving device 400 for receiving a radio signal transmitted by a transmitting device such as transmitting device 300. Receiving device 400 includes receiver 402, processor 404, transmitter 406 and memory 410. According to certain embodiments, receiving device 400 includes clock 408, antenna 412, and demodulator 414. These components are functional components whose functions may be performed by discrete devices or by one or more general purpose or special purpose microprocessors. These functions may also be performed by application specific integrated circuits or other dedicated components. Instructions for performing these functions may be included in one or more programs stored in memory 410 that, when executed by processor 404, cause receiving device 400 to perform the functions described below. According to certain embodiments, a processor may be a general purpose processor or it may be specially selected for performing the below functions. According to certain embodiments, device 400 includes one or more off-the-shelf components enabling device 400 to be made inexpensively. For example, according to certain embodiments, device 400 includes an off-the-shelf dual-band FM receiver, and off-the-shelf GPS module, and a general purpose microprocessor.

Receiver 402 receives radio signals sent by one or more transmitting devices, such as transmitting device 300. The received signals include messages formatted in accordance with a standard GNSS message. For example, according to certain embodiments, the received signals include messages formatted in accordance with a standard GPS message. Formats of GNSS messages are known in the art and briefly summarized above with respect to GPS. According to certain embodiments, a message formatted in accordance with a standard GNSS message may include a PRBS code and a navigation message.

According to certain embodiments, receiver 402 is an FM receiver configured to receive FM radio signals. In certain embodiments, receiver 402 is a dual-band FM radio receiver configured to receive radio signals on two FM frequency bands. According to certain embodiments, receiver 402 intercepts radio frequency signals by way of antenna 412 that is coupled to a front end of receiver 402. The front end of receiver 402 may include one or more filters and low-noise amplifiers that receive incoming radio signals.

According to certain embodiments, receiver 402 includes a mixer for down-converting the incoming radio signal to a lower frequency for easier processing. According to certain embodiments, the mixer receives the radio signal to be down-converted and a signal from a local oscillator, such as clock 408, that may have a frequency lower than the frequency of the radio signal. In response to these signals, the mixer produces an intermediate frequency (IF) signal that may further be driven to an IF filter from where a filtered IF signal may be driven to demodulator 414. The IF signal has an amplitude proportional to the amplitude of the radio signal and a frequency lower than the frequency of the radio signal. In some embodiments, receiver 402 includes one or more oscillators that are independent from clock 408. According to certain embodiments, two local oscillators, one for each incoming radio frequency band are used to generate two IF signals, one for each band. Clock 408 may include a high frequency oscillator such as a crystal oscillator, a voltage-controlled crystal oscillator, an oven-controlled crystal oscillator, or an atomic frequency reference. Atomic frequency references may be, for example, cesium or rubidium atomic frequency references. Atomic frequency references offer higher accuracy and stability over crystal oscillators allowing for longer holdover times in the event that receiving device 400 fails to acquire timing signals for a period of time. According to certain embodiments, clock 408 is a rubidium clock. According to certain embodiments, clock 408 is a cesium clock allowing for up to 4 months of holdover.

According to certain embodiments, the IF signal generated by receiver 402 is processed by demodulator 414 to extract the digital information modulated on the carrier signal. The demodulated digital information may be passed to processor 404 for extraction of synchronized timing information. According to certain embodiments, a separate demodulator 414 is used for each band of a received dual-band signal.

According to certain embodiments, the IF signal generated by receiver 402 undergoes acquisition and correlation processes, which allow receiving device 400 to lock onto received radio signals and to determine time and timing information, according to methods known in the art. These acquisition and correlation processes may be performed in real time, for example, with hardware correlators. In certain embodiments, a received signal includes a PRBS code encoded on the carrier signal. Receiver 400 locks into the received message by generating and shifting (in time) one or more PRBS codes and comparing the generated code with the demodulated data from the received signal. For a received radio signal, following a down-conversion process to baseband, processor 404 multiplies the received signal by a stored replica of the appropriate PRBS code contained within memory 410, and then integrates, or lowpass filters, the product in order to obtain an indication of the presence of the signal. This process is termed a "correlation" operation. By sequentially adjusting the relative timing of this stored replica relative to the received signal, and observing the correlation output, processor 404 can determine the time delay between the received signal and clock 408. The initial determination of the presence of such an output is termed "acquisition." Once acquisition occurs, the process enters the "tracking" phase in which the timing of clock 408 is adjusted in small amounts in order to maintain a high correlation (synchronized) output. The correlation output during the tracking phase may be viewed as the received signal with the pseudorandom bit sequence removed, or, in common terminology, "despread." This signal may be narrow band, with bandwidth commensurate with a 50 bit per second binary phase shift keyed data signal which is superimposed on the one or more FM carrier signal waveforms.

In some embodiments, complete timing signals are received at a higher rate than used in a GNSS system. For example, a timing signal may be received once every second. Timing signals received at higher rates enable receiving device 400 to conduct acquisition much more quickly.

Processor 404 extracts time information from the despread signal. According to certain embodiments, processor 404 extracts a navigation message that may include information about time, time of day, and time standard correction factors, in accordance with a standard GNSS navigation message. In some embodiments, certain portions of a standard GNSS message are not present in the message. For example, satellite ephemeris information and almanac information may not be included. In certain embodiments, almanac information is included in the message to provide calibration information to receivers.

Processor 404 determines synchronized time information based on the extracted time information. Accurate synchronization may be determined by determining the amount of time for a received radio signal to travel from the transmitting device to receiving device 400 and offsetting the time information contained in the received radio signal by the determined travel time. In certain embodiments, the travel time is determined based on a known distance between the transmitting device and receiving device 400. For example, the distance may be stored in memory 410. In certain embodiments, the distance between the transmitting device and receiving device 400 is not known and receiving device 400 must determine the distance. In certain embodiments, receiving device 400 determines the distance based on its own known location and the location of the transmitting device extracted from the message included in the radio signal. In certain embodiments, receiving device 400 does not know its own location and may determine its own location by receiving and processing radio signals from multiple transmitting devices. According to certain embodiments, receiving device 400 processes radio signals from 3 transmitting devices to determine its own location and establish accurate timing. According to certain embodiments, receiving device 400 processes radio signals from six transmitting devices to establish accurate timing.

Based on the established synchronization, processor 404 may generate timing information that may include timing and frequency information. For example, processor 404 may generate 1 pps timing information synchronized to the time standard based on the start time of a received 1 pps timing signal and 10 MHz frequency information also synchronized to the time standard by disciplining an on-board clock, such as clock 408. In some embodiments, processor 404 extracts absolute time from the message demodulated from the received radio signal and generates time information. For example, according to certain embodiments, processor 404 composes an Inter Range Instrument Group (TRIG) standard time code. IRIG Standard 200-04 is a standardized time code developed by the United States Range Commanders Council and is often used to distribute a GPS derived reference time to non-GPS enabled devices, thereby establishing a synchronized time reference for a group of connected devices. The timing information generated and transmitted by receiving device 400 is synchronized to the time standard. According to certain embodiments, the synchronization is accurate to within 10 microsecond of the time standard. According to certain embodiments, the synchronization is accurate to within 1 microsecond of the time standard. According to certain embodiments, the synchronization is accurate to within plus or minus 1 microsecond of UTC.

The synchronized timing information generated by processor 404 is communicated to connected end-user devices or systems, such as critical infrastructure installations. For example, where receiving device 400 is co-located with a power monitoring unit (PMU) for monitoring a portion of a power grid, the timing information may be communicated to the PMU, providing it with accurate and precise time, timing, and frequency information synchronized to the time standard. In certain embodiments, timing information is communicated to an end-user device or system using radio frequency transmission through transmitter 406 that may be connected to the end-user through electrical or optical wiring. According to certain embodiments, the timing information generated by processor 404 is converted into a radio signal by signal generator 418 and then transmitted by transmitter 406. In certain embodiments, transmitter 406 transmits over fiber optic cable by converting the electrical radio signals generated by signal generator 418 to optical radio signals, via electrical-to-optical (E/O) converters.

In certain embodiments, receiving device 400 communicates timing information via an internet protocol network.

For example, receiving device may communicate timing information using Network Time Protocol or Precision Time Protocol through communication port 416. When using NTP, an end-user device sends requests for time to receiving device 400, which sends the time as a response. Precision Time Protocol (PTP) is a client-server protocol that is generally driven by a server, which hosts a so-called "master clock." In a standard PTP time update, the master clock multicasts a Sync Message containing the time to a number of slave clocks residing at clients. After a short delay, the server transmits a follow-up message which contains the time that the Sync Message "hit the wire." To the extent that the time transfer delay is caused by transmission delays internal to the master clock and network contention (i.e., two or more simultaneous attempts to access a network resource), the slave clock can be set correctly using this information. If there are network devices such as switches and routers that can cause additional delay between the master and slave clocks, PTP anticipates that they will add information about those delays to the Sync Message in transit. Such devices are called "transparent clocks" in the PTP standard. PTP also has a second transaction type that is used to calculate round trip time, and this is driven by the slave clock (i.e., client). In this transaction, the client sends a Delay Request message to the master clock and receives a response that allows the client to compute round trip delay.

According to certain embodiments, receiving device 400 is configured to receive and process both FM radio signal timing messages from transmitting device 300 and GNSS signals from one or more GNSS satellites. In these embodiments, receiving device 400 may use the FM radio signal timing as backup to GNSS in the case of GNSS failure. In certain embodiments, receiving device 400 includes GNSS receiver 412. GNSS receiver 412 may receive signals through antenna 412 and process the signals to produce synchronized timing information. In certain embodiments, GNSS receiver 412 processes received GNSS signals independent of the other receiving device 400 components used to process received FM signals described above. In certain embodiments, GNSS receiver 412 shares certain components. For example GNSS receiver 412 may share components of receiver 402, memory 410, and/or processor 404. According to certain embodiments, GNSS receiver 412 may output a pulse synchronized to a time standard (e.g., 1 pps synchronized to UTC) and processor 404 may use this pulse to generate synchronized timing information in lieu of the information received from demodulator 414.

According to certain embodiments, processor 404 may select the synchronized timing source (FM signals or GNSS signals) based on a detected error in the received radio signal data or the GNSS receiver data in various ways. For example, GNSS receiver 412 may be configured to output an error message or signal when some error in timing information generation exists. For example, where the GNSS receiver 412 is unable to receive a GNSS satellite signal, GNSS receiver 412 may output an error message. Similarly, processor 404 may be able to determine an error in timing generation from the radio signal due to, for example, poor FM signal strength or high noise. Processor 404 may switch between FM signals or GNSS signals when no signal is received from one or the other.

In some embodiments, management module analyzes data received from the radio signal and selects the GNSS receiver data for generating timing information when poor timing synchronization is detected. In certain embodiments, an external management and control unit sends instructions to processor 404 to select one or the other timing source.

Accordingly, the described receiving devices receive radio signals transmitted by transmitting devices and generate synchronized timing information for use by critical infrastructure installations. The received radio signals contain messages formatted in accordance with a GNSS standard. Receiving devices extract synchronized time information from the radio signals and generate timing signals based at least partially on that time information and on knowledge of the relative positions of the transmitting devices. The generated timing signals are transmitted to end-user systems and devices, such as critical infrastructure installations, that rely on synchronized timing.

Receiving System

According to certain embodiments, receiving systems include receiving modules for receiving radio signals transmitted by transmitting devices and GNSS modules for receiving GNSS signals transmitted by GNSS satellites and distribute synchronized timing to critical infrastructure installations based on the availability or quality of the respective timing sources. Receiving modules receive the radio signals transmitted by the transmitting devices, such as transmitting device 300, and generate synchronized timing information. The received radio signals contain messages formatted in accordance with a GNSS standard. The receiving modules extract synchronized time information from the radio signals and generate timing signals based at least partially on that time information and on knowledge of the relative positions of the transmitting devices. GNSS modules produce conventional GNSS timing outputs. The receiving systems select which timing output—the output from a receiving module or the output from a GNSS module—to distribute to end-user systems and devices. According to certain embodiments, the selected timing signals are transmitted to end-user systems and devices, such as critical infrastructure installations, that rely on synchronized timing.

Figure 5:
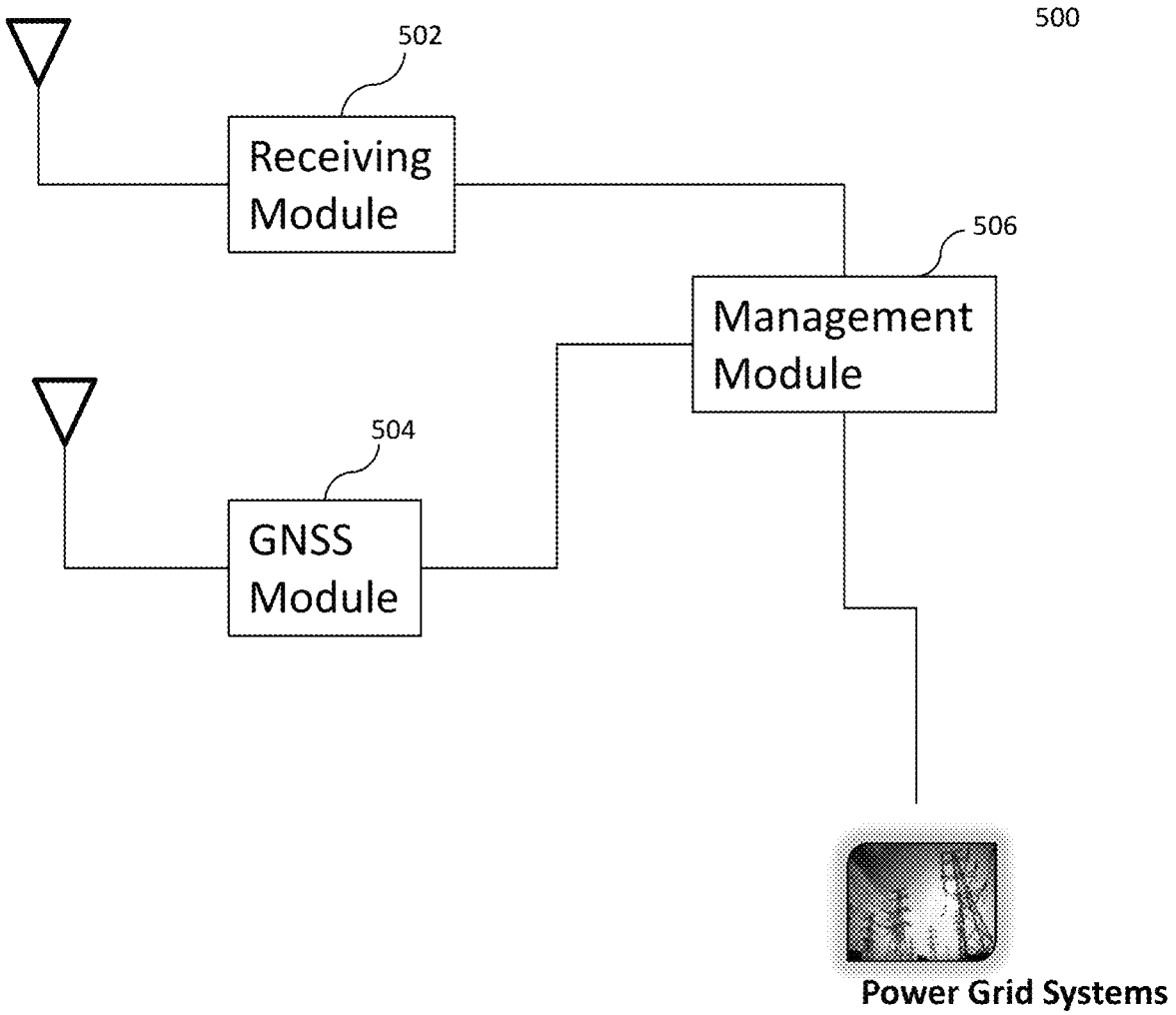
FIG. 5 is an illustration of a receiving system for receiving synchronized timing according to certain embodiments.

FIG. 5 is an illustration of receiving system 500. Receiving system 500 includes receiving module 502, GNSS module 504, and management module 506. Receiving system 500 provides redundant timing information for serving as a robust timing source for critical infrastructure. Receiving module 502 receives and processes FM radio signals containing synchronized timing data sent by one or more transmitting devices 402 in accordance with the methods and systems described herein. GNSS module 504 receives and processes standard GNSS signals and generates standard GNSS receiver outputs. Management module 506 detects one or more errors in receiving module 502 and GNSS module 504 and selects which module to use to provide timing information to end-users.

In certain embodiments, receiving module 502 and GNSS module 504 each output the timing information required by an end-user device or system. For example, each outputs 1 pps timing, 10 MHz reference frequency, and TRIG timecodes. In these embodiments, management module 502 serves as a gateway, selecting which module's output to use and distributing the output to the end-user system or equipment in a feedthrough manner. In these embodiments, management module 502 does not alter the signals generated by the receiving module 502 or GNSS module 504.

In certain embodiments, receiving module 502 and GNSS module 504 output limited synchronized timing data. For example, receiving module 502 and GNSS module 504 output only a 1 pps timing pulse synchronized to the time standard. Management module 506 includes components to generate additional timing information required by end-user systems and devices. For example, management module 506 uses the 1 pps timing pulse to discipline a local oscillator, and the oscillator's output is used to generate a reference frequency, which may be transmitted to end-user systems and devices. Furthermore, management module 506 may be configured to generate a timecode such as an TRIG timecode based on the 1 pps signal from the receiving module and/or GNSS module.

According to certain embodiments, management module 506 includes communication components to communicate the timing information to end-user systems. For example, management module 506 may include a signal generator for generating radio signals for transmission over electrical or optical wiring. Management module 506 may also include IP communication components for communicating timing information using, for example, PTP and/or NTP.

Management module 506 may select a default source when no error is detected. For example, the GNSS output may be the default timing source and the management module 506 may only select the receiving module when an error is detected in the GNSS module 504.

Management module 506 may detect an error in receiving module 502 and GNSS module 504 in various ways. For example, receiving module 502 and/or GNSS module 504 may be configured to output an error message or signal when some error in timing information generation exists. For example, where the GNSS module 504 is unable to receive a GNSS satellite signal, GNSS module 504 may output an error message. Similarly, according to certain embodiments, receiving module 502 is able to determine an error in timing generation due to, for example, poor FM signal strength or high noise, and to output an error signal. Management module 506 may also detect an error when no output is received from a module.

In some embodiments, management module 506 analyzes the outputs received from receiving module 502 and GNSS module 504 and selects one or the other depending on various criteria. For example, management module 506 may track or calculate the synchronization qualities of the outputs from the two modules and select the one with higher quality.

Accordingly, the described receiving systems include receiving modules for receiving radio signals transmitted by transmitting devices and GNSS modules for receiving GNSS signals transmitted by a GNSS satellites and distribute synchronized timing to critical infrastructure installations based on the availability or quality of the respective timing sources. The receiving modules extract synchronized time information from the radio signals and generate timing signals based at least partially on that time information and on knowledge of the relative positions of the transmitting devices. GNSS modules produce conventional GNSS timing outputs. The receiving systems select which timing output—the output from a receiving module or the output from a GNSS module—to distribute to end-user systems and devices. According to certain embodiments, the selected timing signals are transmitted to end-user systems and devices, such as critical infrastructure installations, that rely on synchronized timing.

Transmission Method

According to certain embodiments, a transmission method may be used to receive a reference signal that includes reference timing information synchronized to a time standard. The method includes composing a message formatted in accordance with a GNSS standard that includes synchronized timing information based at least partially on the reference timing information. The method also includes transmitting the message on a radio signal. According to certain embodiments, the transmitted timing information is synchronized to the time standard with accuracy within 500 nanoseconds. The transmitted timing information may be received and used to provide synchronized timing to critical infrastructure installations.

Figure 6:
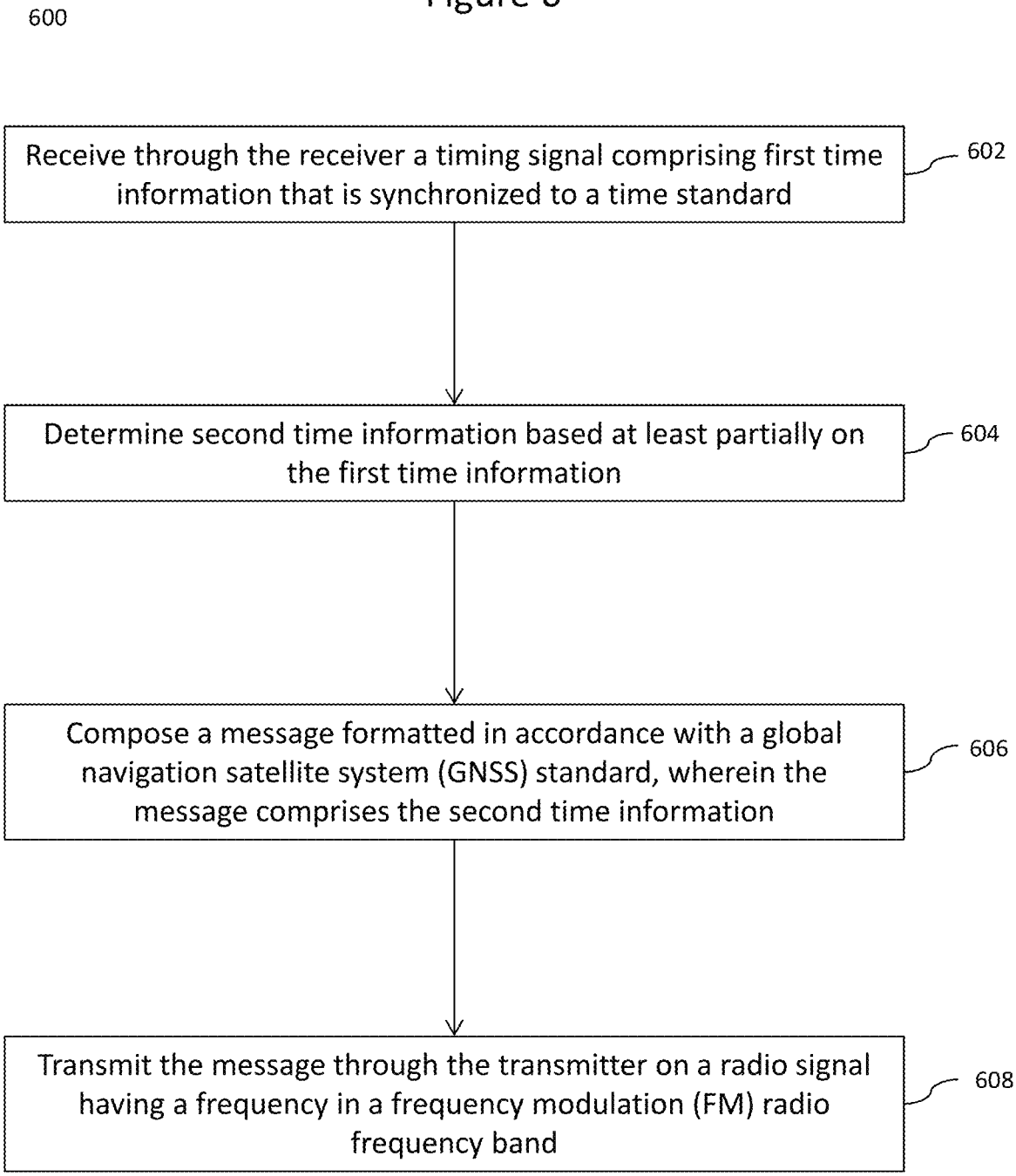
FIG. 6 is a flow diagram illustrating a method of transmitting synchronized timing according to certain embodiments.

FIG. 6 is a method for transmitting synchronized timing according to certain embodiments. Method 600 is performed by a device with a receiver, a transmitter, memory, and one or more processors. For example, method 600 may be performed by transmitting unit 300 (FIG. 3). Method 600 is used to transmit timing information that is synchronized to a time standard using radio signals. Synchronized timing information may be received at end-user systems and devices, such as critical infrastructure locations that depend on receiving reliable timing information. According to method 600, the timing information transmitted to receiving devices is generated based on reference timing received from a ground-based reference provider. The reference timing information is independent of a GNSS system, and therefore, is not affected by a GNSS system failure. Accordingly, method 600 may be used to transmit accurate timing in the event of a GNSS failure. Furthermore, GNSS system vulnerabilities, such as low signal strength and GNSS targeted jamming and spoofing do not affect the transmission of timing information according to method 600. Additionally, because radio signals may be received at locations without line of sight to the sky (and, thus, GNSS satellites), broadcast timing information according to method 600 may be received at end-user system and device locations where GNSS receivers may be ineffective. Therefore method 600 may be used to provide reliable timing information to the critical infrastructure locations independent of GNSS.

At step 602, a signal that includes time information synchronized to a time standard is received through a receiver. The signal may be received from a reference timing provider and may include both reference timing and reference frequency information that is synchronized to a time standard. The reference timing may be in the form of a pulse-per-second (pps), for example 1 pps, and the reference frequency may be 1, 2.5, 5, 10, 15, or 20 MHz. In certain embodiments, the reference frequency is 10 MHz. According to certain embodiments, the timing information contained in the signal received from the reference timing provider is synchronized to a time standard with an accuracy of within 10 nanoseconds. In some embodiments, the timing information is synchronized to UTC with an accuracy of within 100 nanoseconds, within 2 nanoseconds or under 1 nanosecond.

In certain embodiments, the signal is an optical radio frequency signal received through a fiber optic cable. In these embodiments, method 600 includes a step of converting the incoming optical radio signal to electrical radio signals, which are then passed on for extraction of the reference timing information.

In certain embodiments, method 600 includes the step of exchanging timing information with a reference provider using TWFTFT methods. In some embodiments, process 600 includes the step of generating a 10 MHz reference frequency and 1 pps reference timing synchronized to UTC based on the TWFTFT exchange.

At step 604, synchronized timing information is determined based at least partially on the received reference timing information. According to certain embodiments, the synchronized timing information is determined based on both the reference timing and reference frequency received at step 602. In certain embodiments, method 600 includes a step of disciplining a clock using the reference timing and reference frequency.

At step 606, a message is composed that includes the synchronized timing information. According to certain embodiments a message is composed includes the timing information derived from the disciplined clock. According to certain embodiments, the message is composed with a format that is in accordance with a standard GNSS message. For example, according to certain embodiments, the message is formatted in accordance with a standard GPS message. Methods of formatting GNSS messages are known in the art and briefly summarized above with respect to the GPS system. According to certain embodiments, a message formatted in accordance with a standard GPS message may include a PRBS code and a navigation message that may include information about time, time of day, and time standard correction factors. In some embodiments, certain portions of a standard GNSS message are not used. For example, satellite ephemeris information and almanac information may not be used. In certain embodiments, almanac information may be included in the message composed to provide calibration information to receivers. In certain embodiments, a message formatted in accordance with a standard GNSS message is modified to account for more frequent transmission times.

According to certain embodiments, one or more carrier signals are generated to carry the composed message containing timing information. According to certain embodiments, the carrier signal is generated with a frequency in the FM radio frequency band. For example, the carrier signal may be generated with a frequency in the range of 88 to 108 MHz. In certain embodiments, the carrier signal frequency may be between 75 and 110 MHz. In certain embodiments, the carrier signal frequency is above or below a designated FM radio frequency band. For example, the carrier signal frequency may be in a range of 50 MHz to 250 MHz. In some embodiments, two carrier signals at different frequencies are generated for dual band FM radio transmission. According to certain embodiments, the carrier signal is generated using the disciplined frequency generated by the disciplined clock. Generating one or more carrier signals, according to certain embodiments, may include steps of frequency dividing and multiplying to generate the one or more carrier frequencies from the disciplined clock frequency. According to certain embodiments, the generated carrier signal has a center frequency of 100 MHz.

According to certain embodiments, method 600 includes the step of generating a message signal containing the composed message. According to certain embodiments, generating the message signal includes the steps of generating a high frequency PRBS code and a low frequency signal containing a navigation message. According to certain embodiment, the message signal is added to the one or more carrier signals by modulating the one or more carrier signals according to known digital modulation techniques. For example, method 600 may employ various digital modulation techniques, including phase-shift keying (such as BPSK or Quadrature PSK) and frequency-shift keying (FSK). In some embodiments, the navigation message is contained in a 50 Hz signal that is a binary phase shift keyed (BPSK) data stream, superimposed on a 1.023 MHz PRBS code, with bit boundaries aligned with the beginning of a PN frame.

At step 608, the message is transmitted on a radio signal having a frequency in an FM radio frequency band. Step 600 may include conditioning the FM radio signal, which may include various steps of filtering and amplifying the signal. In certain embodiments, phase and ducting compensation are added to the signal to improve signal quality. The signal is transmitted to a radio antenna for broadcast. According to certain embodiments, two FM radio signals, each of which contains the timing message, are simultaneously transmitted with two different carrier frequencies.

According to certain embodiments, the transmitted timing information is synchronized to the time standard with accuracy within 500 nanoseconds. The timing information transmitted by transmitting device 300 may be received and used to provide synchronized timing to critical infrastructure.

In certain embodiments, method 600 includes the step of encrypting the message prior to broadcasting according to various methods of encryption well known in the art.

Reception Method

According to certain embodiments, receiving methods may be used to receive radio signals transmitted by transmitting devices, such as transmitting device 300 and generate synchronized timing information for use by critical infrastructure installations. The received radio signals contain messages formatted in accordance with a GNSS standard. The methods include extracting synchronized time information from the radio signals and generating timing signals based at least partially on that time information and on knowledge of the relative positions of the transmitting devices. The generated timing signals are transmitted to end-user systems and devices, such as critical infrastructure installations, that rely on synchronized timing.

Figure 7:
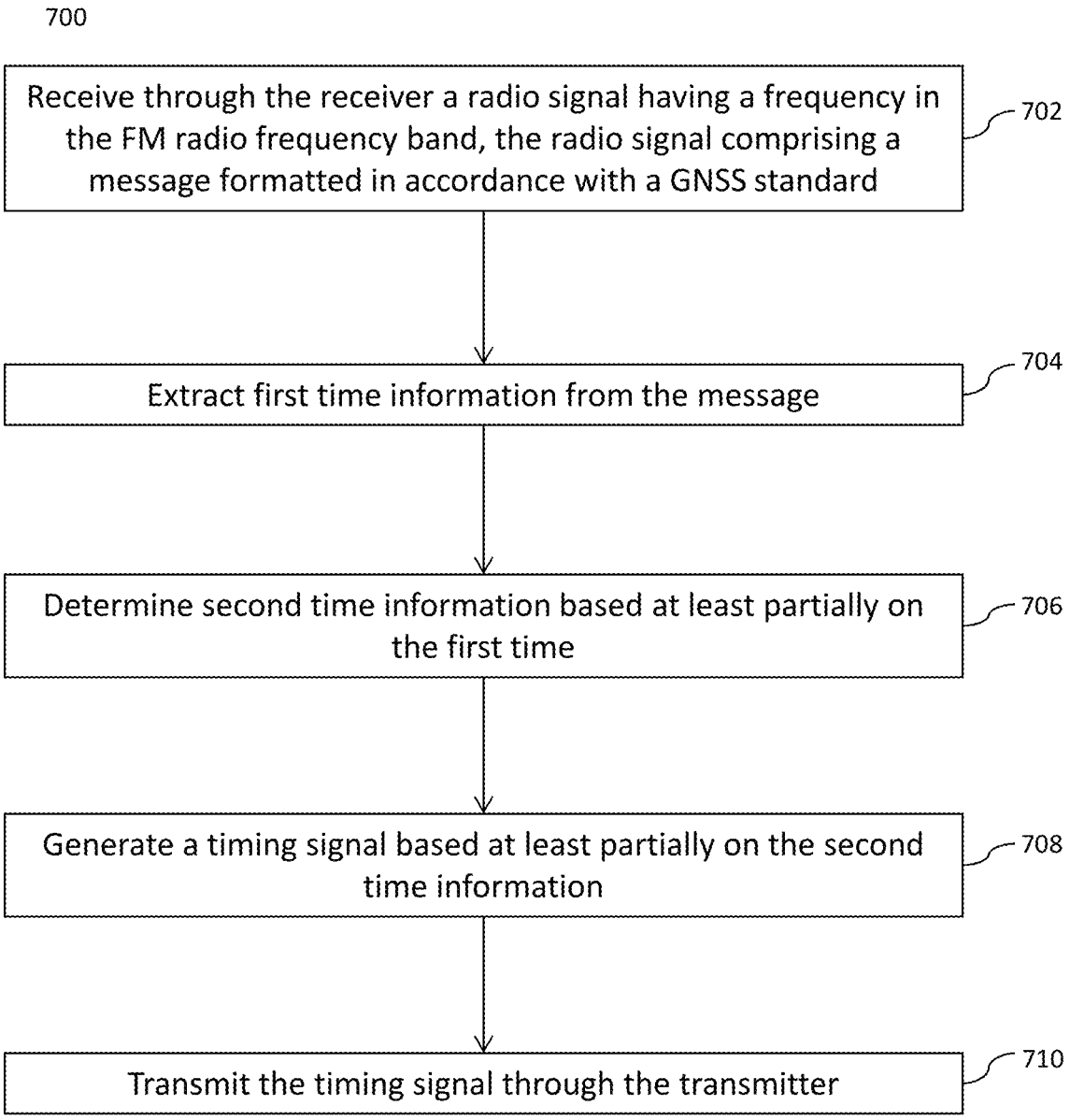
FIG. 7 is a flow diagram illustrating a method of receiving synchronized timing according to certain embodiments.

FIG. 7 illustrates method 700 for receiving an FM radio signal transmitted by, for example, transmitting device 300. Method 700 may be performed by one or more devices having a receiver, a transmitter, memory, and one or more processors. For example, method 700 may be performed by one or more receiving devices 400 to receive one or more radio signals that contain messages formatted in accordance with a GNSS standard. Method 700 includes steps for extracting the time information from the radio signals and generating one or more timing signals based at least partially on that time information and on knowledge of the relative positions of the one or more transmitting devices. Generated timing signals may be transmitted to end-user systems and devices, such as critical infrastructure installation, that rely on synchronized timing, according to method 700.

At step 702, a radio signal having a frequency in the FM radio frequency band is received. The radio signal includes a message formatted in accordance with a GNSS standard. In certain embodiments, two radio signals are received, each having a different center frequency and each including the message formatted in accordance with a GNSS standard. According to certain embodiments, one or more filtration and amplification steps may be applied to the incoming radio signal. According to certain embodiments, the radio signal may be down-converted by a mixer before being processed.

According to certain embodiments, method 700 includes the step of down-converting the radio signal using a local oscillator, such as clock 408 in FIG. 4, that may have a frequency lower than the frequency of the radio signal. In some embodiments, an intermediate frequency (IF) signal is generated by driving the down-converted radio signal through an IF filter. According to certain embodiments, the generated IF signal is demodulated to extract the digital information modulated on the carrier signal. The demodulated digital information is passed on for extraction of timing information.

According to certain embodiments, acquisition and correlation are performed using the demodulated digital information based on methods well known in the art and described above. In some embodiments, method 700 includes the steps of multiplying the received signal by a stored replica of the appropriate PRBS code contained within a memory, and then integrating, or filtering, the product in order to obtain an indication of the presence of the signal. Relative timing of this stored replica is sequentially adjusted relative to the received signal, and the correlation output is observed to determine the time delay between the received signal and an internal clock. According to certain embodiments, an internal clock is adjusted in small amounts in order to maintain a high correlation (synchronized) output.

At step 704, time information is extracted based on the correlation process and the despread signal. In some embodiments, a navigation message, which may include transmitter location, clock corrections, time-of-week information, information about other transmitters, and other system parameters, is extracted from the despread signal.

At step 706, determines synchronized time information is determined based on the extracted time information. Accurate synchronization may be determined by determining the amount of time for a received radio signal to travel from the transmitting device to receiving device 400 and offsetting the time information contained in the received radio signal by the determined travel time. In certain embodiments, the travel time is determined based on a known distance between the transmitting device and receiving device 400. For example, the distance may be stored in memory 410. In certain embodiments, the distance between the transmitting device and receiving device 400 is not known and receiving device 400 must determine the distance. In certain embodiments, receiving device 400 determines the distance based on its own known location and the location of the transmitting device extracted from the message included in the radio signal. In certain embodiments, receiving device 400 does not know its own location and may determine its own location by receiving and processing radio signals from multiple transmitting devices. According to certain embodiments, receiving device 400 processes radio signals from 3 transmitting devices to determine its own location and establish accurate timing. According to certain embodiments, receiving device 400 processes radio signals from six transmitting devices to establish accurate timing.

At step 708, a timing signal that includes synchronized timing information is generated based on the information extracted from the radio signal. The generated timing information may include timing and frequency information. For example, 1 pps timing information synchronized to the time standard and 10 MHz frequency information also synchronized to the time standard may be generated. In some embodiments, absolute time is extracted from the message demodulated from the received radio signal and a time code is generated. For example, according to certain embodiments, an IRIG standard time code is generated.

At step 710, the timing signal that includes synchronized timing information generated by processor 404 is transmitted to end-user devices or systems, such as critical infrastructure installations. In certain embodiments, timing information is communicated to an end-user device or system using radio frequency transmission through electrical or optical wiring. The generated timing information is converted into a radio frequency signal and then transmitted to the end-user systems and devices. In certain embodiments in which the timing signal is transmitted to end-users over fiber optic cabling, method 700 includes the step of converting the electrical radio frequency signals to optical radio frequency signals.

According to certain embodiments, a method includes the additional steps of generating a GNSS-based time information and generating synchronized timing based on a selection between the GNSS-based time information and the radio signal-based time information. In these embodiments, the FM radio signal time information may be used as backup to GNSS in the case of GNSS failure. In certain embodiments, according to certain embodiments, the selection may be based on detecting an error in the received radio signal data or the GNSS data in various ways. For example, an error message may be received for the GNSS-based information or the radio signal-based information when some error in timing information generation exists.

Monitor and Control

Distribution of synchronized by systems according to certain embodiments may be monitored and controlled using a monitoring and control system. The monitor and control system may communicate with one or more transmitting device and one or more receiving device, along with one or more synchronized timing reference sources to monitor the accuracy of the synchronized timing generated and distributed by the system. Monitor and control systems may provide calibration and/or correction information to the transmitting and receiving devices to improve synchronization. According to certain embodiments, monitor and control systems maintain system security by providing and updating encryption information to the transmitting and receiving devices.

Figure 8:
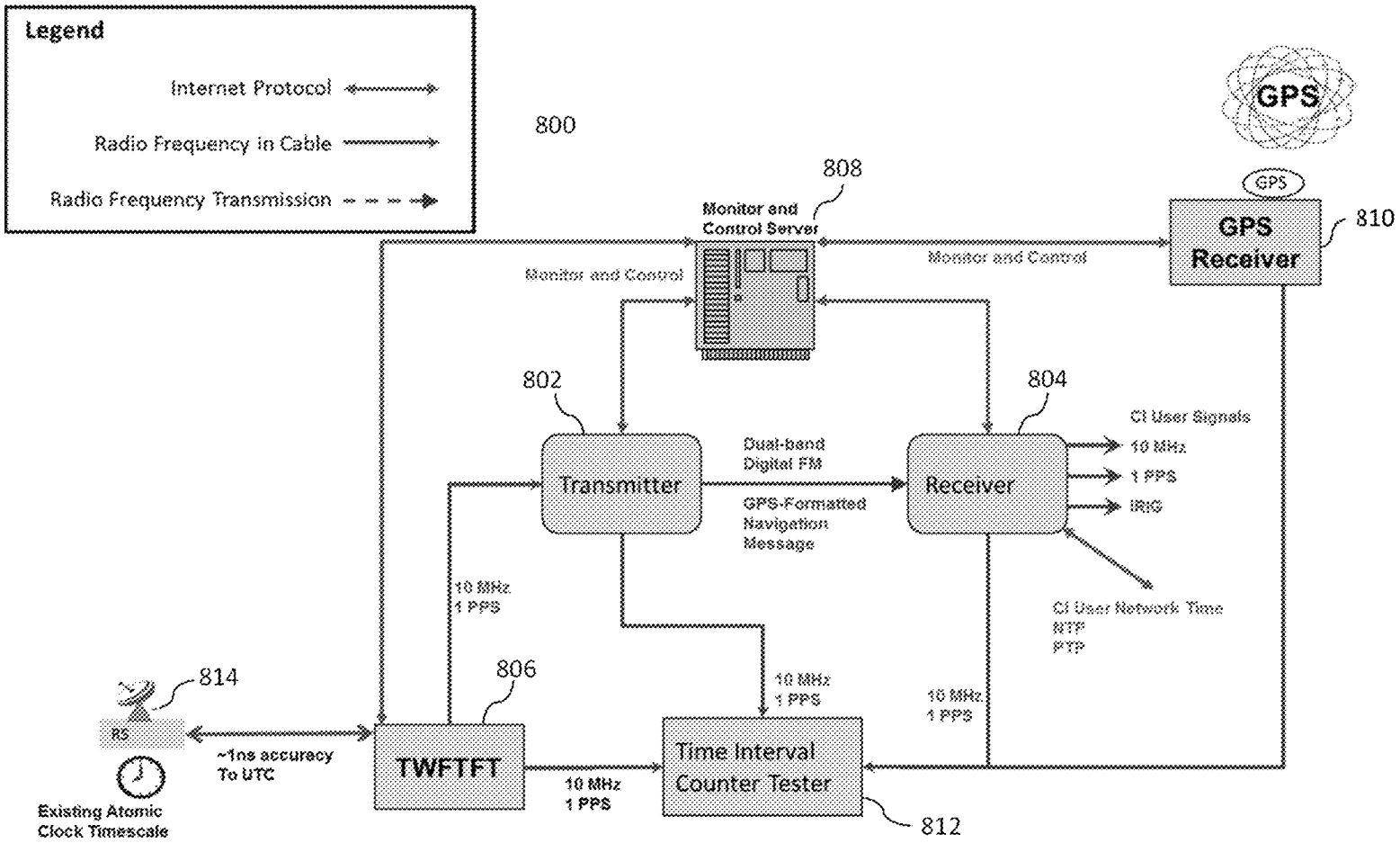
FIG. 8 is a system for monitoring and controlling a synchronized timing system according to certain embodiments.

FIG. 8 is an illustration of timing distribution system 800 according to certain embodiments. Timing distribution system 800 includes monitor and control module 808, which monitors the entire system in order to maintain high timing synchronization accuracy and system security. System 800 includes one or more transmitting devices 802, one or more receiving devices 804, TWFTFT module 806, GNSS reference module 810, and time interval counter tester 812. TWFTFT module 806 receives reference timing information from ground-based reference station 814. TWFTFT module 806 generates timing and frequency reference information, for example a 1 pps timing reference and 10 MHz frequency reference, and transmits this information to transmitter 802. In some embodiments, this information is transmitted radio frequency in fiber optics. Transmitter 802 broadcasts timing information based on the received reference information in the manners discussed above. Transmitter 802 also transmits a generated timing reference to time interval counter tester 812. Transmitter 802 communicates with monitor and control module 808, for example, over an internet protocol network. Receiver 804 receives broadcast radio signals and extracts timing information in accordance with the methods and systems described above. Receiver 804 generates timing information, which is used to generate timing signals that are passed to end-user systems and devices and to time interval counter tester 812. Receiver 804 may send timing signals to time interval counter tester 812 using radio frequency in fiber optics. Receiver 804 may communicate with monitor and control module 808, for example, over an internet protocol network. GNSS reference module 810 generates reference timing and frequency information derived from GPS and transmits the information to time interval counter tester 812.

Time interval counter tester 812 compares the synchronized timing information from the various sources—transmitter 802, receiver 804, TWSTFT module 806, and GPS reference module 810—to determine the performance of transmitter 802 and receiver 804.

Monitor and control module 808 can communicate, for example over internet protocol, with TWFTFT module 806 and GNSS reference module 810. Monitor and control module 808 monitors the quality of the synchronized timing transferred, received, and generated throughout the system.

In some embodiments, monitor and control unit 812 communicates with each element in system 800 using secure socket layer (SSL) and/or TLS flows. For example, AES-256 encrypted control messages over SSL and/or TLS may be used. Other encryption algorithms may be used to communicate between monitor and control unit 812 and each element in system 800. According to certain embodiments, communication includes FIPS 140-2 compliant algorithms. According to certain embodiments, encryption keys are stored in PKI NPE certificates (e.g., X.509). These keys may be used to encrypt the SSL/TLS data flows. According to certain embodiments, the keys used for monitor and control are different from as the keys used to encrypt the TWSTFT and/or digital FM radio communications. According to certain embodiments, monitor and control unit 812 supports a FIPS 140-2 compliant algorithm for message authentication with NPE PKI certificates at transmitting units, receiving units, and end-user systems and devices. Monitor and control unit 812 may provide keying over the network (KOTN) or over the air rekeying (OTAR) for agile and frequent re-key to mitigate spoofing attacks.

The above encrypted communication methods and standards are given by way of example. One of skill in the art will appreciate that other encrypted communication methods and standards may be readily utilized.

Accordingly, described monitoring and control systems may monitor and control accurate synchronized timing throughout a system of transmitting and receiving devices. The monitor and control system may communicate with one or more transmitting device and one or more receiving device, along with one or more synchronized timing reference sources to monitor the accuracy of the synchronized timing generated and distributed by the system. Monitor and control systems may provide calibration and/or correction information to the transmitting and receiving devices to improve synchronization. According to certain embodiments, monitor and control systems maintain system security by providing and updating encryption information to the transmitting and receiving devices.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

What is claimed as new and desired to be protected by Letters Patent of the United States is:

1. A device for transmitting synchronized timing comprising:

a receiver, wherein the receiver is configured to receive a timing signal from a ground-based reference clock;

a transmitter;

a clock, wherein the clock is configured to generate a clock signal;

a time interval counter tester, wherein the time interval counter tester is configured to compare timing information from a plurality of sources to determine the performance of the receiver and the transmitter;

a two-way time and frequency transfer (TWFTFT) unit, wherein the TWFTFT unit is configured to exchange timing information between the receiver and the ground-based reference clock;

one or more processors;

memory; and one or more programs, wherein the one or more programs are stored in the memory and configured to be executed by the one or more processors, the programs including instructions for:

receiving through the receiver the timing signal comprising first time information that is synchronized to a time standard;

adjusting a timing information at the receiver and frequency information of the clock signal based on the received first time information;

determining second time information based on the adjusted timing and frequency information of the clock signal;

transmitting the second time information from the receiver to the transmitter;

composing a message formatted in accordance with a global navigation satellite system (GNSS) standard at the transmitter, wherein the message comprises the second time information and a pseudorandom noise code unique to the device;

transmitting the message through the transmitter on a signal having a frequency in a frequency modulation (FM) radio frequency band; and comparing the timing signal from the ground-based clock with a timing signal received from a GPS receiver using the time interval counter tester to determine the performance of the transmitter and the receiver.

2. The device of claim 1, wherein the time standard is Coordinated Universal Time (UTC).

3. The device of claim 1, wherein the synchronization of the first time information to the time standard is accurate to within 10 nanoseconds.

4. The device of claim 1, wherein the first time information is independent of a GNSS.

5. The device of claim 1, wherein the receiver is configured to receive the timing signal over fiber optic cable from the ground-based reference clock.

6. The device of claim 1, wherein the second time information is synchronized to the time standard and the synchronization is accurate to within 500 nanoseconds.

7. The device of claim 1, wherein the message further comprises a location of the device.

8. The device of claim 1, wherein the transmitter is configured to simultaneously transmit the message on two signals having frequencies in the FM radio frequency band.

9. The device of claim 1, further including instructions stored within the memory for encrypting the message prior to transmitting the message through the transmitter.

10. The device of claim 1, wherein the message comprises at least one of a time-of-week information and clock correction information.

11. A method comprising:

an electronic device with a processor, a clock configured to generate a clock signal, a receiver, and a transmitter:

receiving through the receiver a timing signal from a ground-based reference clock comprising first time information that is synchronized to a time standard wherein a two-way time and frequency (TWFTFT) unit is used to exchange the first time information between the receiver and the ground-base reference clock;

adjusting a timing information and frequency information of the clock signal at the receiver based on the received first time information;

determining second time information at the receiver based on the adjusted timing and frequency information of the clock signal;

transmitting the second time information from the receiver to the transmitter;

composing a message formatted in accordance with a GNSS standard at the transmitter, wherein the message comprises the second time information and a pseudorandom noise code unique to the device;

transmitting the message through the transmitter on a signal having a frequency in an FM radio frequency band; and comparing the timing signal from the ground-based clock with a timing signal received from a GPS receiver using a time interval counter tester to determine the performance of the transmitter and the receiver.

12. The method of claim 11, wherein the time standard is UTC.

13. The method of claim 11, wherein the synchronization of the first time information to the time standard is accurate to within 10 nanoseconds.

14. The method of claim 11, wherein the first time information is independent of a GNSS.

15. The method of claim 11, wherein the receiver is configured to receive the timing signal over fiber optic cable from the ground-based reference clock.

16. The method of claim 11, wherein the second time information is synchronized to the time standard and the synchronization is accurate to within 500 nanoseconds.

17. The method of claim 11, wherein the message further comprises a location of the device.

18. The method of claim 11, wherein the transmitter is configured to simultaneously transmit the message on two signals having frequencies in the FM radio frequency band.

19. The method of claim 11, further comprising encrypting the message prior to transmitting the message through the transmitter.

20. The method of claim 11, wherein the message comprises at least one of time-of-week information and clock correction information.

21. A receiving device comprising:

a first receiver;

a second receiver, wherein the second receiver is configured to receive a second signal;

a transmitter;

one or more processors;

memory; and one or more programs, wherein the one or more programs are stored in the memory and configured to be executed by the one or more processors, the programs including instructions for:

receiving through the first receiver a first signal having a frequency in an FM radio frequency band from a transmitting device, the first signal comprising a message formatted in accordance with a GNSS standard and including a pseudorandom noise code unique to the transmitting device;

extracting first time information from the message;

determining second time information based on the first time information and a pre-determined distance between the receiving device and the transmitting device, wherein the second time information is synchronized to a time standard;

generating a timing signal based at least partially on the second time information; and transmitting the timing signal through the transmitter, wherein transmitting the timing signal includes transmitting the signal to a time interval counter tester, wherein the time interval counter tester is configured to compare a timing signal from a ground-based clock with a timing signal received from a GPS receiver and the timing signal transmitted through the transmitter to determine the performance of a synchronized timing system.

22. The receiving device of claim 21, wherein the synchronization of the second time information is accurate to within 10 microseconds relative to the time standard.

23. The receiving device of claim 21, wherein the receiver is configured to simultaneously receive two signals having frequencies in an FM radio frequency band.

24. The receiving device of claim 21, including instructions stored within the memory for decrypting the message.

25. The receiving device of claim 21, wherein the message comprises at least one of time-of-week information and clock correction information.

26. The receiving device of claim 21, wherein the second receiver is further configured to determine a GNSS time information from the second signal, and further including instructions for:

detecting one or more errors in the first signal and the second signal; and generating the timing signal based at least partially on the second time information when a second signal error is detected and at least partially on the GNSS time information when a first signal error is detected.

27. A receiving method comprising:

an electronic device with a processor, a first receiver, a second receiver, wherein the second receiver is configured to receive a second signal, and a transmitter:

receiving through the first receiver a first signal having a frequency in the FM radio frequency band from a transmitting device, the first signal comprising a message formatted in accordance with a GNSS standard and including a pseudorandom noise code unique to the transmitting device;

extracting first time information from the message;

determining second time information based on the first time information and a pre-determined distance between the receiving device and the transmitting device, wherein the second time information is synchronized to a time standard;

generating a timing signal based at least partially on the second time information; and transmitting the timing signal through the transmitter, wherein transmitting the timing signal includes transmitting the signal to a time interval counter tester, wherein the time interval counter tester is configured to compare a timing signal from a ground-based clock with a timing signal received from a GPS receiver and the timing signal transmitted through the transmitter to determine the performance of a synchronized timing system.

28. The receiving method of claim 27, wherein the synchronization of the second time information is accurate to within 10 microseconds relative to the time standard.

29. The receiving method of claim 27, wherein the receiver is configured to simultaneously receive two signals having frequencies in an FM radio frequency band.

30. The receiving method of claim 27, including decrypting the message.

31. The receiving method of claim 27, wherein the message comprises at least one of time-of-week information and clock correction information.

32. The receiving method of claim 27, wherein the second receiver is further configured to determine a GNSS time information from the second signal, and further including instructions for:

detecting one or more errors in the first signal and the second signal; and generating the timing signal based at least partially on the second time information when a second signal error is detected and at least partially on the GNSS time information when a first signal error is detected.

33. A non-transitory computer readable storage medium storing one or more programs, the one or more programs comprising instructions, which when executed by an electronic device with a first receiver, a second receiver, and a transmitter, cause the device to:

receive through the first receiver a first signal having a frequency in the FM radio frequency band from a transmitting device, the first signal comprising a message formatted in accordance with a GNSS standard and including a pseudorandom noise code unique to the transmitting device;

extract first time information from the message;

determine second time information based on the first time information and a pre-determined distance between the receiving device and the transmitting device, wherein the second time information is synchronized to a time standard;

generate a timing signal based at least partially on the second time information;

transmit the timing signal through the transmitter, wherein transmitting the timing signal includes transmitting the signal to a time interval counter tester, wherein the time interval counter tester is configured to compare a timing signal from a ground-based clock with a timing signal received from a GPS receiver and the timing signal transmitted through the transmitter to determine the performance of a synchronized timing system; and receive through the second receiver a second signal and transmit a second timing signal based at least partially on the second signal.

34. A system comprising:

a transmitting unit comprising:

a first receiver, wherein the first receiver is configured to receive a first timing signal from a ground-based reference clock;

a first transmitter;

a clock, wherein the clock is configured to generate a clock signal;

one or more first processors;

first memory; and one or more first programs, wherein the one or more first programs are stored in the first memory and configured to be executed by the one or more first processors, the first programs including instructions for:

receiving through the first receiver the first timing signal comprising first time information that is synchronized to a time standard;

adjusting at the first receiver a timing information and frequency information of the clock signal based on the received first time information;

determining second time information based on the adjusted timing and frequency information of the clock signal;

transmitting the second time information from the first receiver to the first transmitter;

composing a message formatted in accordance with a GNSS standard at the transmitter, wherein the message comprises the second time information and a pseudorandom noise code unique to the transmitting unit; and transmitting the message through the first transmitter on a first signal having a frequency in an FM radio frequency band; and a receiving unit comprising:

a second receiver;

a third receiver, wherein the third receiver is configured to receive a second signal;

a second transmitter;

one or more second processors;

second memory; and one or more second programs, wherein the one or more second programs are stored in the second memory and configured to be executed by the one or more second processors, the second programs including instructions for:

receiving through the second receiver the first signal;

extracting the second time information from the message transmitted on the first signal;

determining third time information based on the second time information and a pre-determined distance between the receiving unit and the transmitting unit, wherein the third time information is synchronized to a time standard;

generating a second timing signal based at least partially on the third time information; and transmitting the second timing signal through the second transmitter, wherein transmitting the second timing signal includes transmitting the signal to a time interval counter tester, wherein the time interval counter tester is configured to compare a timing signal from a ground-based clock with a timing signal received from a GPS receiver and the timing signal transmitted through the second transmitter to determine the performance of a synchronized timing system.

35. The system of claim 34, wherein the third time information is synchronized to the time standard with an accuracy of within 10 microseconds.

36. A system comprising:

a receiving module comprising:

a first receiver, wherein the first receiver is configured to receive a first signal;

a second receiver;

a first transmitter;

one or more first processors;

first memory; and one or more first programs, wherein the one or more first programs are stored in the first memory and configured to be executed by the one or more first processors, the first programs including instructions for:

receiving through the first receiver the first signal having a frequency in the FM radio frequency band from a transmitting device, the first signal comprising a message formatted in accordance with a GNSS standard and including a pseudorandom noise code unique to the transmitting device;

extracting first time information from the message;

determining second time information based on the first time information and a pre-determined distance between the receiving device and the transmitting device, wherein the second time information is synchronized to a time standard;

generating a first timing signal based at least partially on the second time information; and transmitting the first timing signal through the first transmitter, wherein transmitting the first timing signal includes transmitting the signal to a time interval counter tester, wherein the time interval counter tester is configured to compare a timing signal from a ground-based clock with a timing signal received from a GPS receiver and the timing signal transmitted through the transmitter to determine the performance of a synchronized timing system;

the second receiver configured to receive a second signal and transmit a GNSS timing signal based at least partially on the second signal; and a management module comprising:

a second transmitter;

one or more second processors;

second memory; and one or more second programs, wherein the one or more second programs are stored in the second memory and configured to be executed by the one or more second processors, the second programs including instructions for:

detecting one or more errors in the first signal and the second signal, and transmitting a second timing signal, wherein the second timing signal is based at least partially on the first timing signal when an error in the second signal is detected and at least partially on the GNSS timing signal when an error in the first signal is detected.

37. The system of claim 36, wherein the one or more errors comprises low signal strength or loss of signal.

* * * * *